US005554260A

United States Patent [19]

Radu et al.

[11] Patent Number: 5,554,260

[45] Date of Patent: Sep. 10, 1996

[54] METHOD AND USE INVOLVING NAPHTHALENE SULPHONATE SALT(S) AND POLYETHYLENE OXIDE, TO IMPROVE RETENTION AND DRAINAGE

[75] Inventors: Georges Radu, Brossard; Pierre Langevin, Jonquiere, both of Canada

[73] Assignee: E.QU.I.P. International Inc., Quebec, Canada

[21] Appl. No.: 256,455

[22] PCT Filed: Nov. 9, 1992

[86] PCT No.: PCT/CA92/00497

§ 371 Date: Oct. 12, 1994

§ 102(e) Date: Oct. 12, 1994

[87] PCT Pub. No.: WO94/11575

PCT Pub. Date: May 26, 1994

[51] Int. Cl.[6] ..... D21H 21/10

[52] U.S. Cl. ..... 162/158; 162/164.1; 162/164.3; 162/183

[58] Field of Search ..... 162/164.1, 164.3, 162/168.1, 158, 169, 183

[56] References Cited

U.S. PATENT DOCUMENTS 4,070,236 1/1978 Carrard et al. ..... 162/165
4,188,446 2/1980 Friedman ..... 428/288
4,313,790 2/1982 Pelton et al. ..... 162/168.1

FOREIGN PATENT DOCUMENTS 1137261 12/1982 Canada .
0203817 12/1986 European Pat. Off. .

OTHER PUBLICATIONS

Database WPIL, Derwent Publication, Ltd., London, GB, CA, A, 2 040 967 (Radu, G.) (Abstract only), Oct., 1992.

*Primary Examiner*—Peter Chin
*Attorney, Agent, or Firm*—McDermott, Will & Emery

[57] ABSTRACT

The present invention relates to a method and a use of naphthalene sulphonate salt(s) under granulated form or as a condensed or diluted solution, and a solution of one or several polyethylene oxide having a molecular weight varying from $1\times10^6$ to $13\times10^6$, allowing for a mixture comprising lignocellulosic particles and an aqueous medium to significantly improve the retention of particles such as fines and fibres, on a wire screen and the drainage of the aqueous medium.

34 Claims, 28 Drawing Sheets

Whiteness before June 30 = 60.7

Whiteness according to the invention = 60.6

OPACITY BEFORE JUNE 30 = 93.2

OPACITY WITH WHITENESS ACCORDING TO THE INVENTION = 93.8

WHITENESS BEFORE JUNE 30 = 60.5

WHITENESS ACCORDING TO THE INVENTION = 60.3

METHOD AND USE INVOLVING NAPHTHALENE SULPHONATE SALT(S) AND POLYETHYLENE OXIDE, TO IMPROVE RETENTION AND DRAINAGE

BACKGROUND OF THE INVENTION

1. Field of Invention

The present invention relates to a method and a use of naphthalene sulphonate salt(s), under granulated form or as a condensed or diluted solution, and a solution of polyethylene oxide having a molecular weight varying from $1\times10^6$ to $13\times10^6$, allowing for a mixture comprising lignocellulosic particles and an aqueous medium to significantly improve the retention of particles such as fines and fibres, on a wire screen and the drainage of the aqueous medium.

Advantageously, a particles retention, especially a retention of fines and fibres can be achieved for kraft, sulphite (high and low yield), bisulphite, mechanical, OPCO, BTCMP, TCMP, BCMP, hard wood, such as oak, birch, maple, elm, wild-cherry, soft woods such as conifere trees, and TMP pulps and any mix in any proportion of two or more types of pulp.

Application of the invention maybe in the following means:

- any washer, thickener, save-all, disc filter or drum filter in any pulp making process;
- any pulp machine, board machine or paper machine in time production sector;
- any clarifier or flotation or fibre separation unit in the effluent treatment process, including krofta, posseidon, sedimentation clarifier, but not limited to these;
- any equipment used in the deinking process, included or not above.

2. Description of the Related Art

Up to now, it was known to use polyethylene oxide to improve from a mixture comprising lignocellulosic fines and fibres, and an aqueous medium, a retention of fines and fibres on a wire screen and improve a drainage of the aqueous medium.

SUMMARY OF THE INVENTION

The Applicant has now surprisingly found that a method involving a combined use of one or several naphthalene sulphonate salt(s), under granulated form or advantageously as a condensed or diluted solution, and a solution of one or several polyethylene oxide having a molecular weight varying from $1\times10^6$ to $13\times10^6$, in admixture with a mixture of lignocellulosic particles and an aqueous medium, allows to improve a retention of said particles on a wire screen and a drainage of said aqueous medium. This combined use shows a synergistic effect. A condensed naththalene sulphonate salt means a solution saturated with said salt, for example a condensed sodium naphthalene sulphonate salt means an aqueous solution containing about 41–46% of said salt.

More particularly, the invention relates to an improvement in a method for the production of paper and analogous products. This improvement is characterized by the fact that one or several naphthalene sulphonate salt(s), said salt(s) being under granulated form or advantageously as a condensed or diluted solution, and a solution of one or several polyethylene oxide having a molecular weight varying from $1\times10^6$ to $13\times10^6$ are admixed with a mixture comprising lignocellulosic particles such as fines and fibres, and an aqueous medium, being understood that polyethylene oxide is admixed with said mixture when said mixture already contains at least a part of said naphthalene sulphonate salt(s).

The invention also relates to the use of one or several naphthalene sulphonate salt(s), said salt(s) being under granulated form or advantageously as a condensed or diluted solution, and a solution of one or several polyethylene oxide having a molecular weight varying from $1\times10^6$ to $13\times10^6$, in admixture with a mixture comprising lignocellulosic particles, such as fines and fibres, and an aqueous medium, to improve a retention of said particles on a wire screen and a drainage of the aqueous medium.

Advantageously, the naphthalene sulphonate salt(s), especially a sodium naphthalene sulphonate salt, is (are) uniformly dispersed in the mixture before introducing one or several polyethylene oxide. Preferably, sodium naphthalene sulphonate should be applied preferably 30 seconds before the salt(s) get(s) in contact with the polyethylene oxide to thus give enough time to the salt to condition particles, such as fines and fibres.

Preferably, in a pulp and paper plant, the admixture of naphthalene sulphonate salt(s) with a mixture of lignocellulosic fines and fibres and aqueous medium may be applied anywhere in the system and advantageously not between fan pumps and a head box. It could be applied in the white water system (wire pit), mixing tank, in the preparation of clay system or any tank that could be in contact with fibre giving on the machine, preferably in the mixed pulp tank. The polyethylene oxide solution may be applied preferably between the fan pump and the head box, but it is also possible to apply it before the fan pump and remain efficient, for example between the mix tank and the fan pump.

Advantageously, one or several naphthalene sulphonate salt(s), said salt(s) being under granulated form or advantageously as a condensed or diluted solution, and a solution of one or several polyethylene oxide having a molecular weight varying from $1\times10^6$ to $13\times10^6$ are admixed with a mixture comprising lignocellulosic fines and fibres and an aqueous medium to define a pumpable pulp.

Advantageously, one or several naphthalene sulphonate salt(s), said salt(s) being under granulated form or advantageously as a condensed or diluted solution, and a solution of one or several polyethylene oxide having a molecular weight varying from $1\times10^6$ to $13\times10^6$ are admixed with a mixture comprising lignocellulosic fines and fibres and an aqueous medium to define an aqueous suspension.

Advantageously, said aqueous suspension is either of the type intended to be laid on a wire screen of a paper machine to form a sheet of paper or of a pulp machine, or of the type defining a white water collected in a wire pit of a paper machine or pulp machine. This white water may be partially or totally recycled as an affluent of a step for preparing a pumpable pulp comprising lignocellulosic fines and fibres and an aqueous medium, or passed at least in part with other waste water through a clarifier. This white water charged with naphthalene sulphonate salt(s) and polyethylene oxide contribute to make the clarifier more efficient.

Advantageously, said aqueous suspension is of the type intended to be laid on a wire screen of a paper machine to form a sheet of paper or of pulp machine type, wherein a white water collected in a wire pit of the paper machine or of a pulp machine and essentially consisting of a part of said previous suspension not retained on the wire screen and still containing naphthalene sulphonate salt(s) and polyethylene oxide, is recycled to a step for preparing either a pumpable pulp or a fresh aqueous suspension intended to be laid on aforesaid wire screen, being understood that said recycled white water contributes to the admixture of a part of the sulphonate salt(s) and polyethylene oxide with the mixture.

Preferably, an equilibrium is set between the amount of naphthalene sulphonate salt(s) and polyethylene oxide retained on the wire screen and the amount of naphthalene sulphonate salt(s) and polyethylene oxide collected in the white water in the wire pit and recycle to the preparation of either a pumpable pulp or a fresh aqueous suspension intended to be laid on the wire screen, to thus allow to admix to said pulp or fresh aqueous suspension intended to be laid on the wire screen, only the amount of naphthalene sulphonate salt(s) and polyethylene oxide retained in the sheet of paper or in the pulp.

Advantageously, naphthalene sulphonate salt(s) are selected from the group consisting of sodium, potassium, ammonium, calcium and aluminium salt(s).

Advantageously, polyethylene oxide has a molecular weight varying from $4,5\times10^6$ to $12\times10^6$.

Advantageously, is further admixed to said mixture at least one enhancer selected from the group consisting of:

a polyaluminium silicate sulphate;

a polyaluminium sulphate;

a sodium aluminate;

polyaluminium chloride;

magnesium hydroxide; and bentonite.

Advantageously, polyethylene oxide may be admixed with the mixture of lignocellulosic particles, such as fines and fibres, and an aqueous medium to represent from 10 to 700 grams per ton of dry matter of said mixture, preferably from 30 to 100 grams per ton of dry matter of said mixture.

EXAMPLE

On a paper machine having a capacity of 600 T of newsprint per day (i.e. a paper machine known under the trade name BELBAE 3 - VERTICAL), a pulp resulting of a blend of 45% of sulphite pulp, 50% of mechanical pulp and 5% of kraft pulp was used.

The example was carried out without and with a condensed solution of sodium naphthalene sulphonate and a solution of a mix polyethylene oxide having a mean molecular weight ranging between 7 to $8\times10^6$ , according to the invention.

The present invention will be better understood with reference to the following figures in which.

The following results were obtained.

Figure 1:
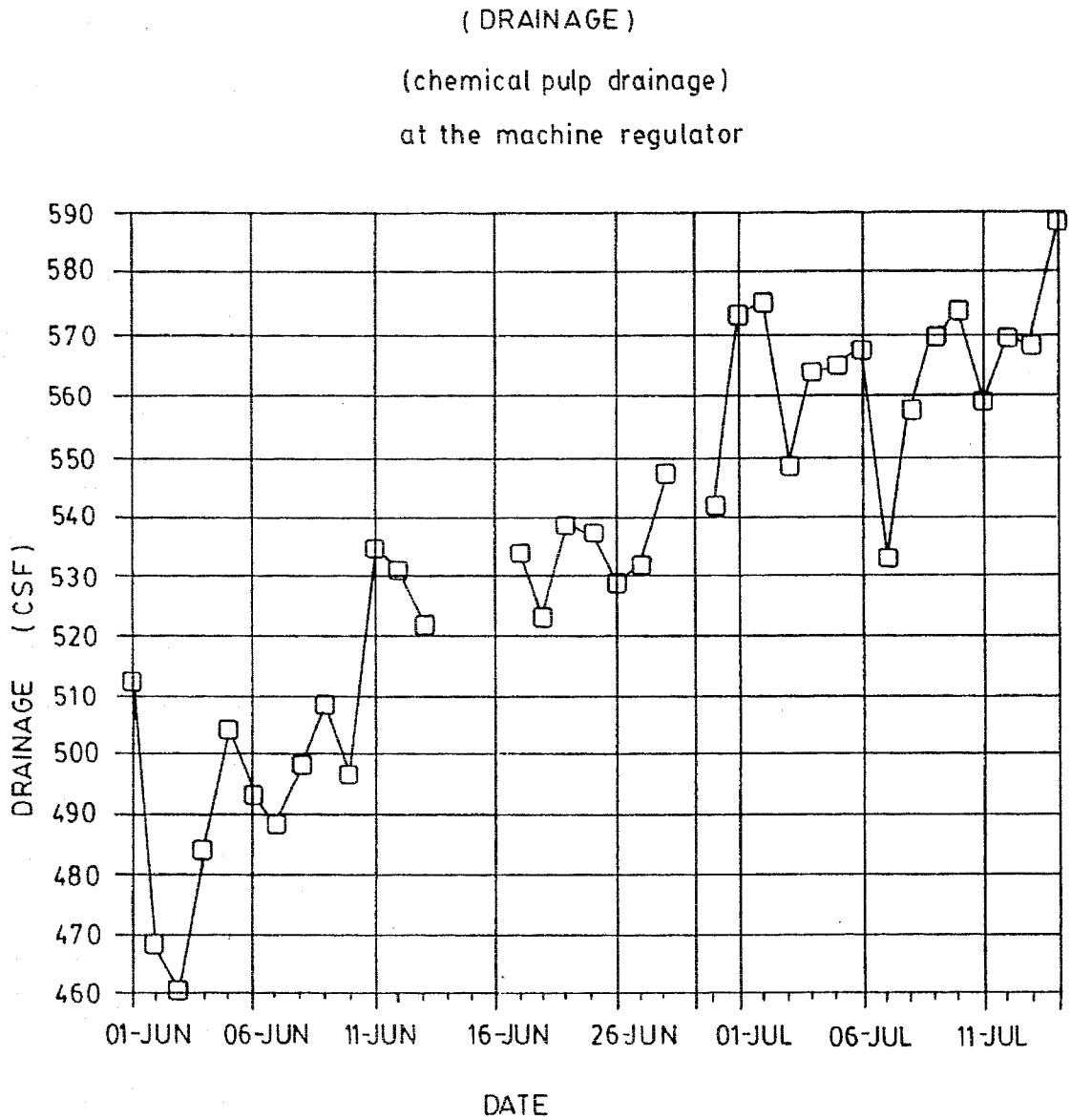
FIGS. 1 to 6 show variations of drainage without and with a combined use of sodium naphthalene sulphonate and polyethylene oxide.
Figure 2:
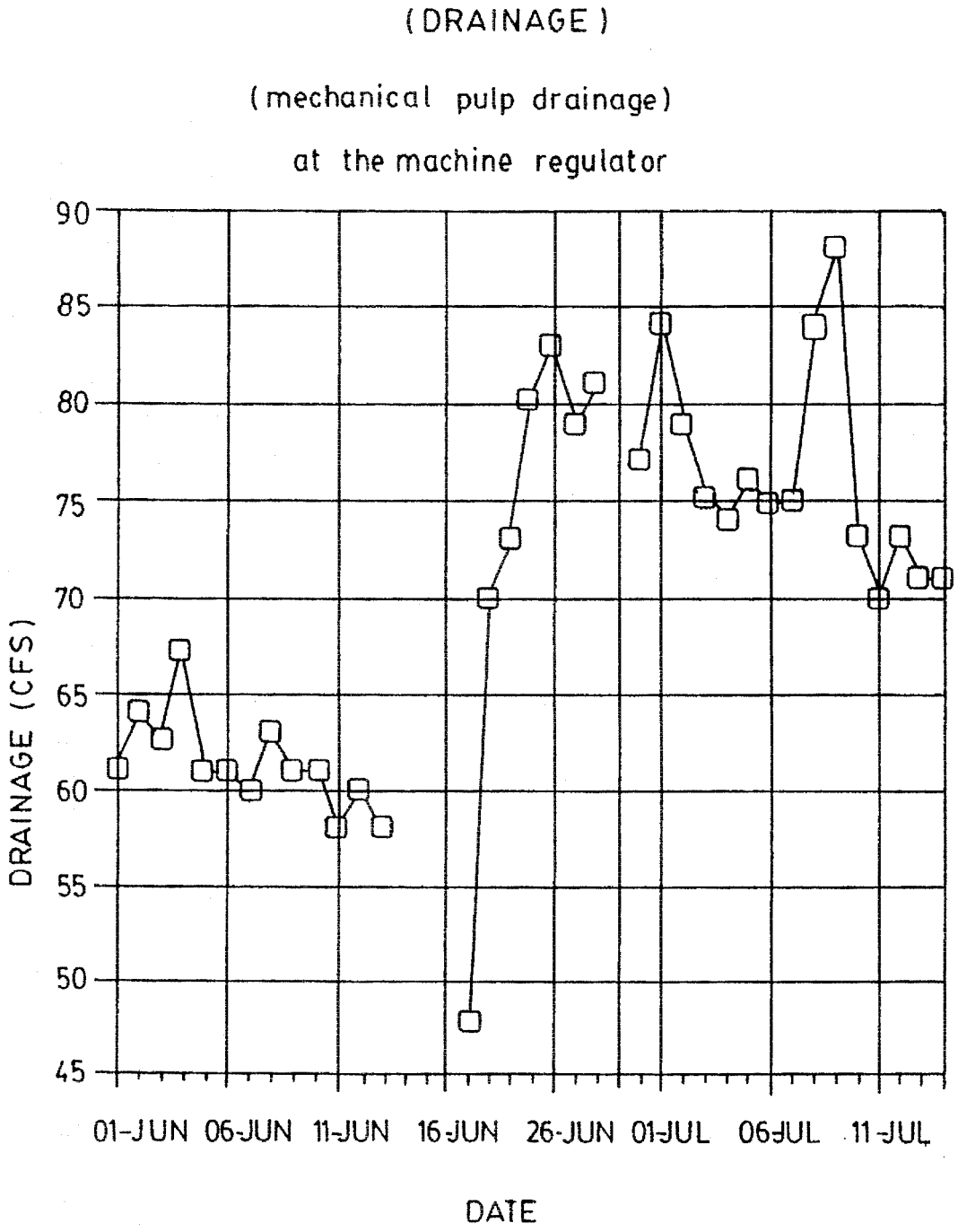
Figure 3:
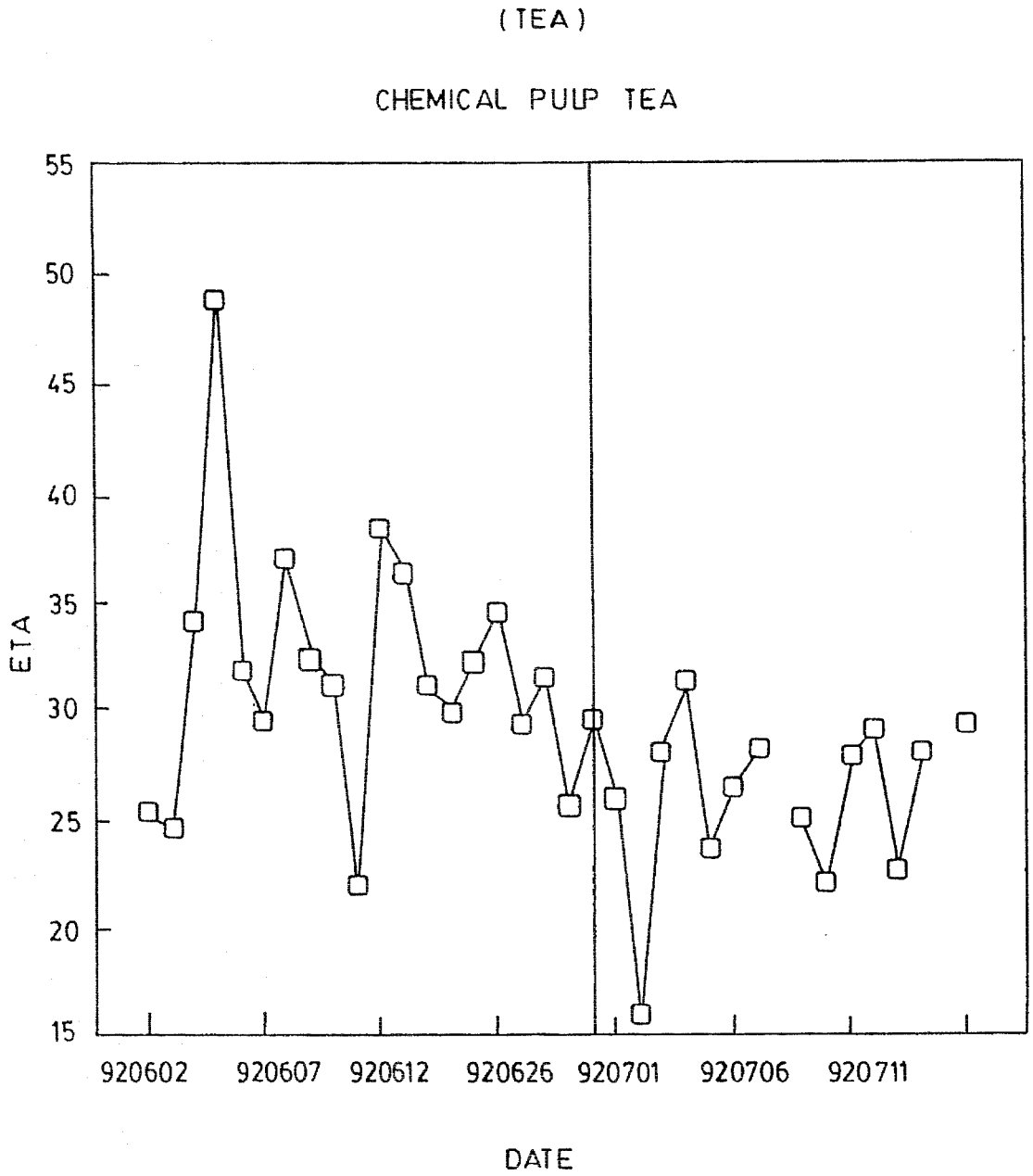
Figure 4:
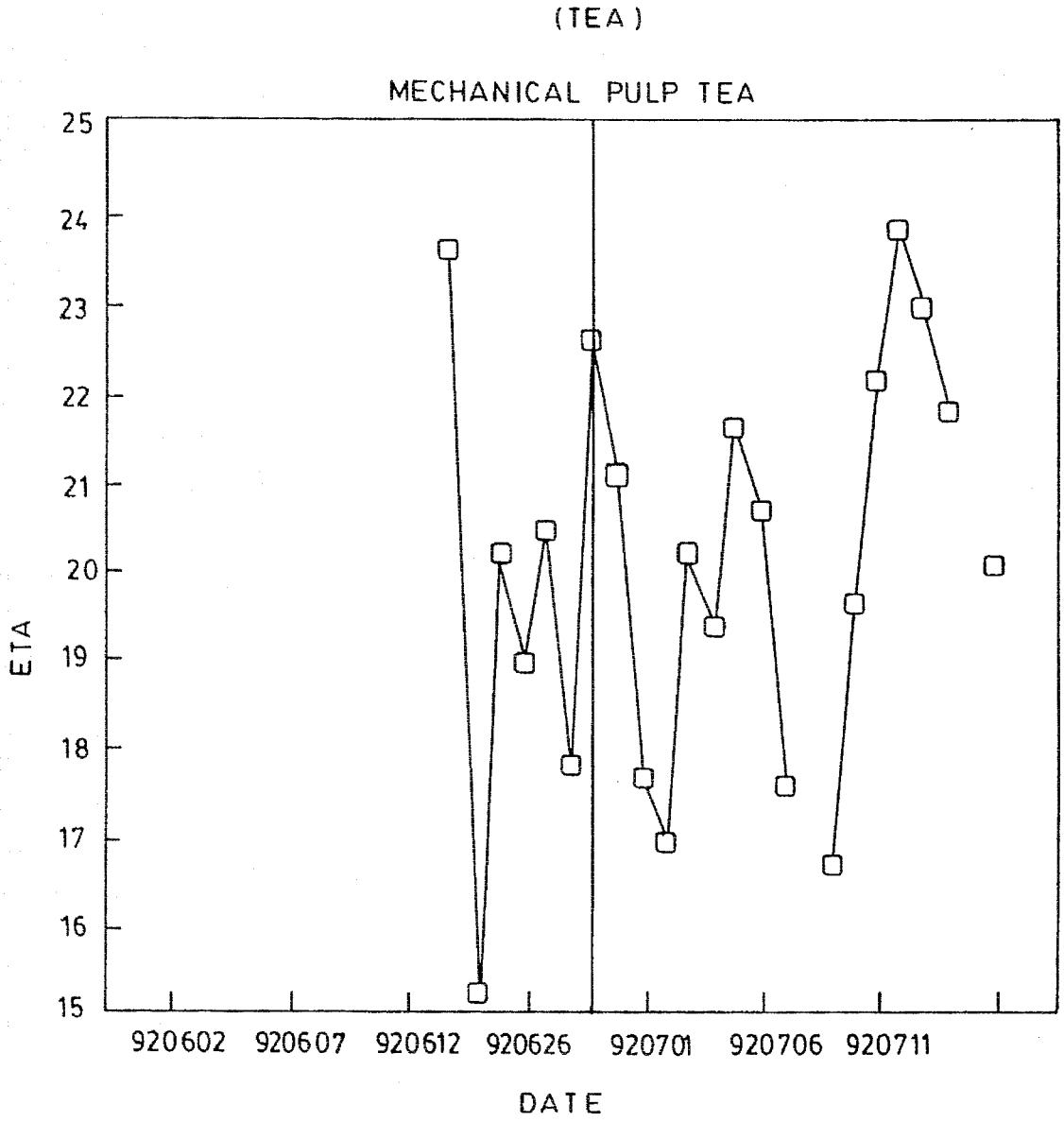
Figure 5:
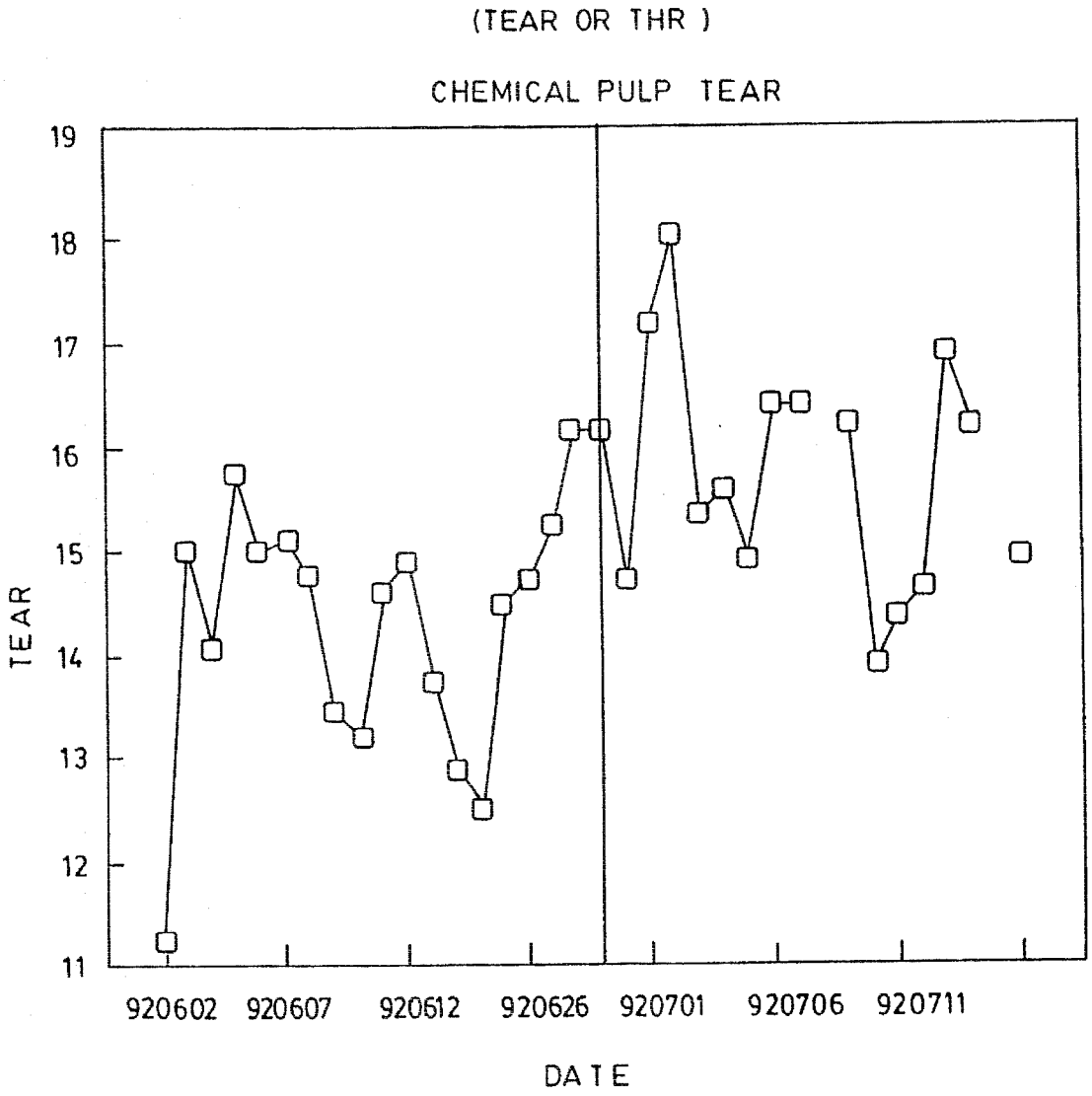
Figure 6:
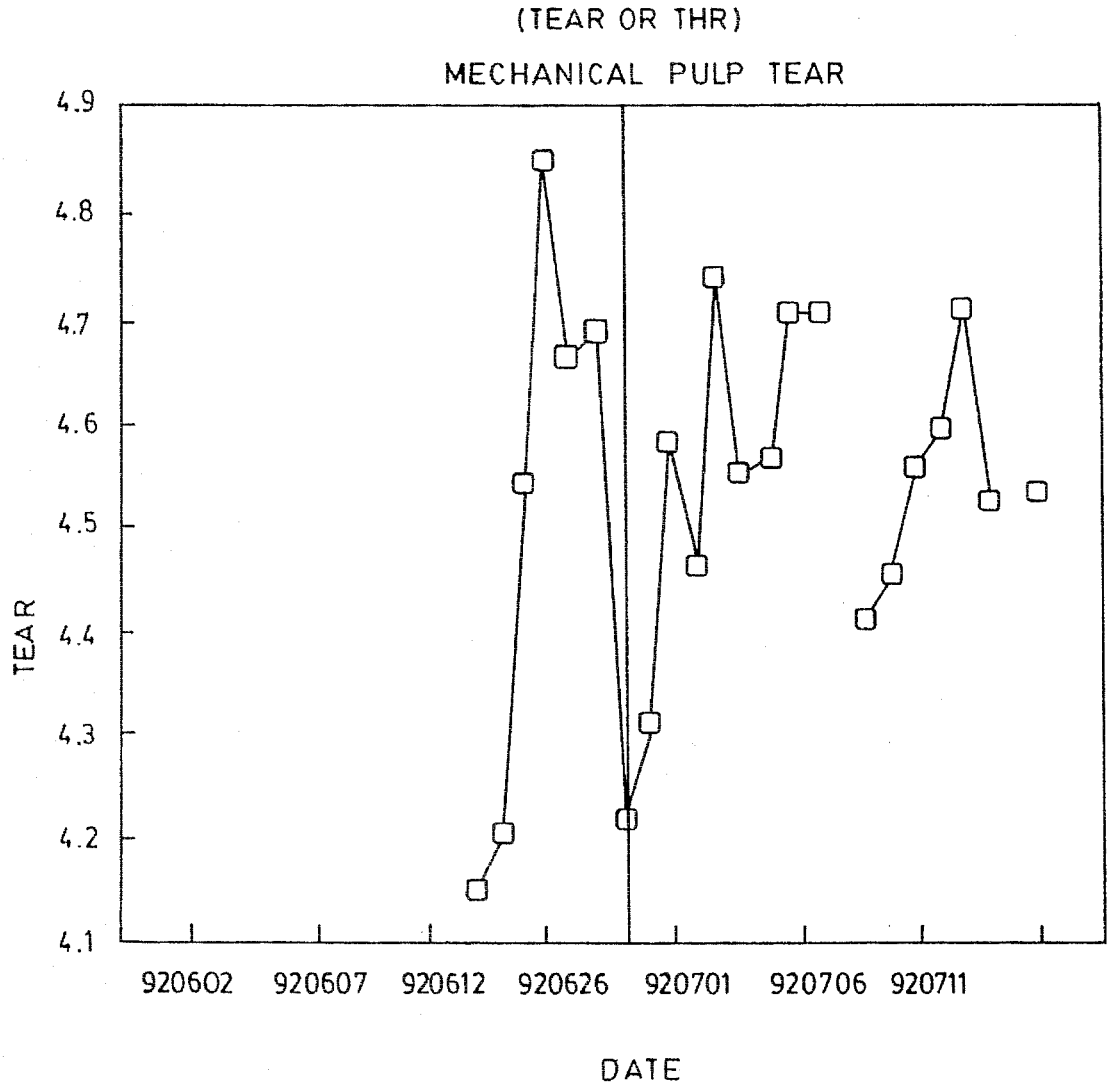
Figure 7:
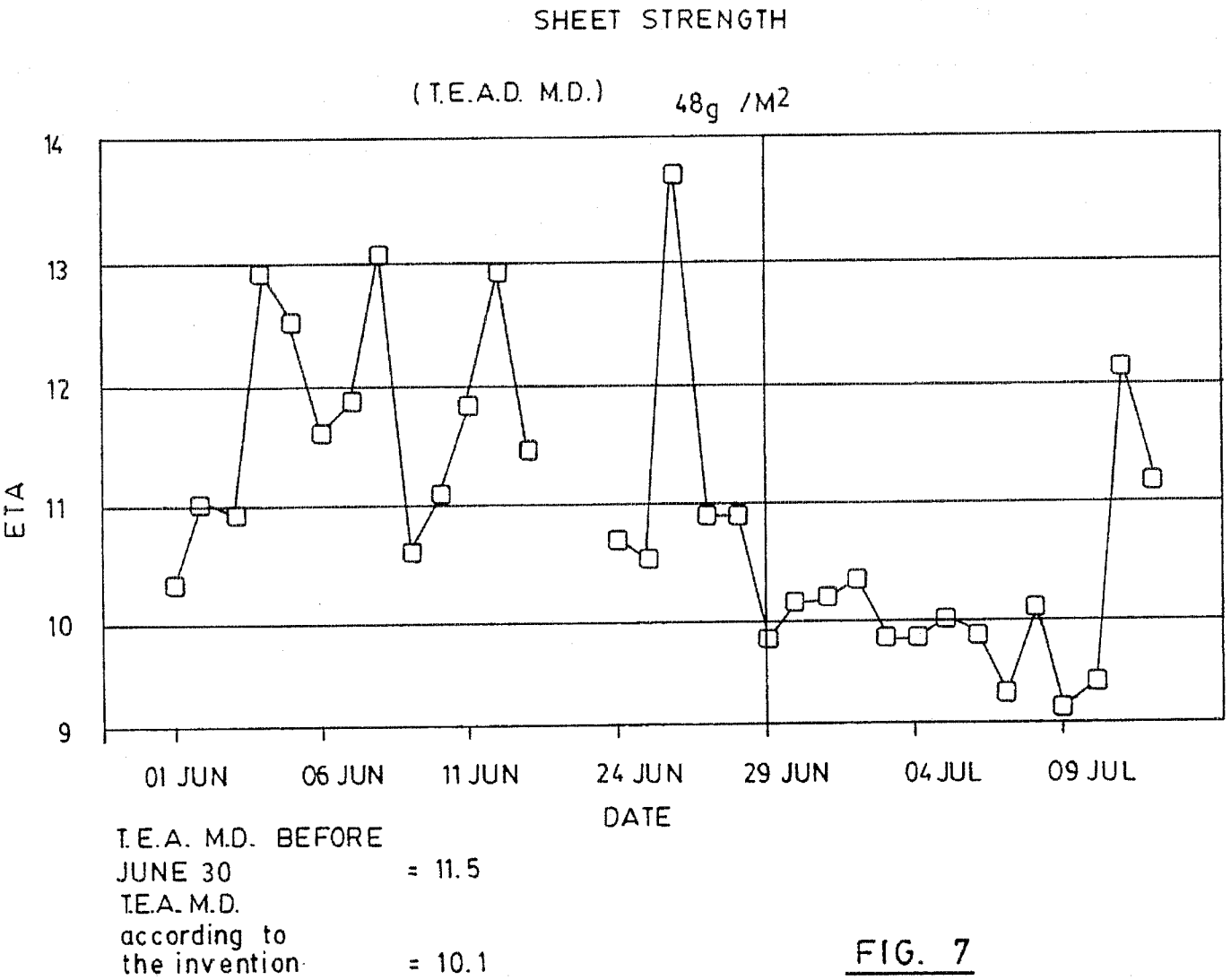
FIGS. 7 to 9 show the sheet strength without and with a combined use of sodium naphthalene sulphonate and polyethylene oxide.
Figure 8:
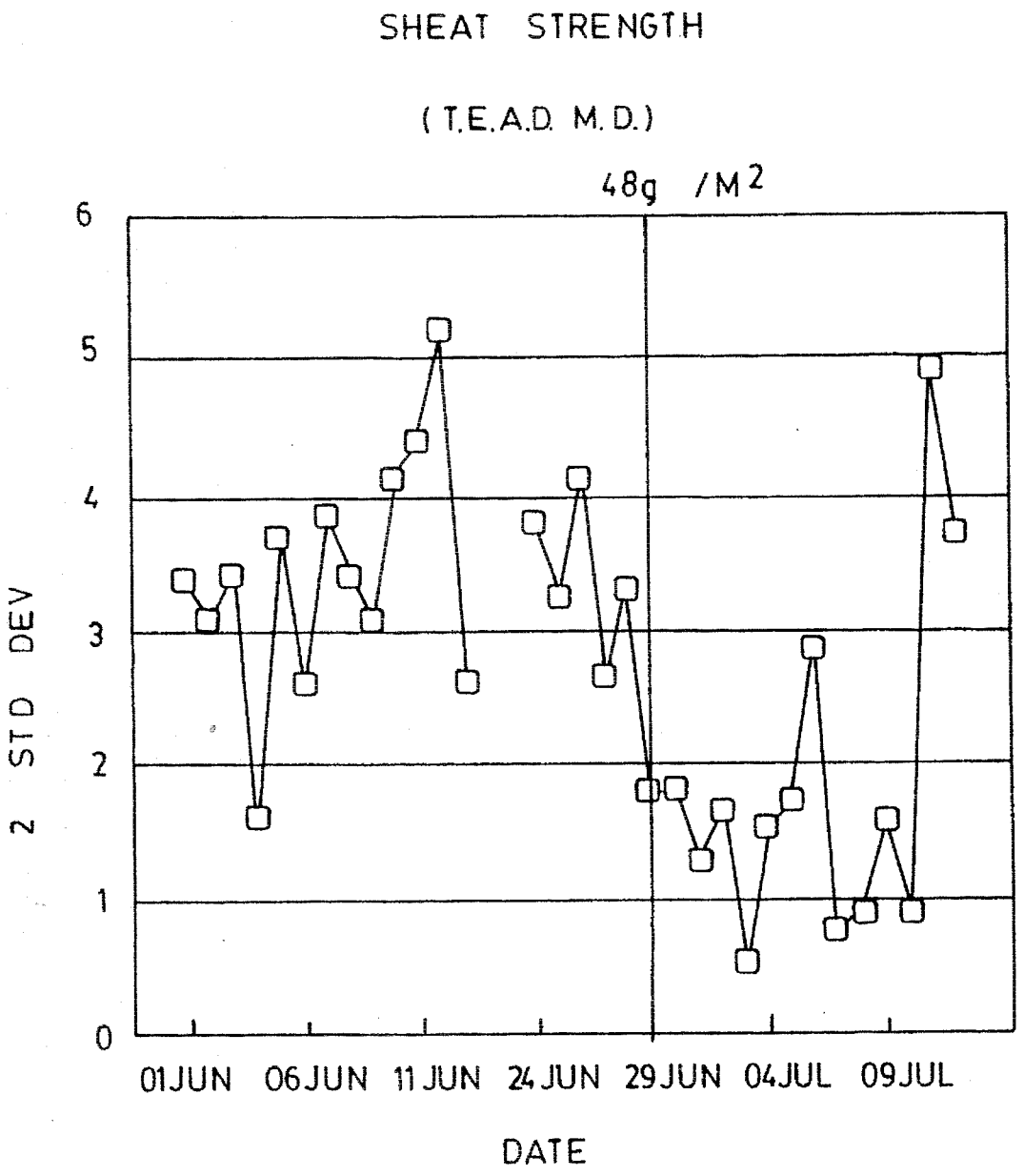
Figure 9:
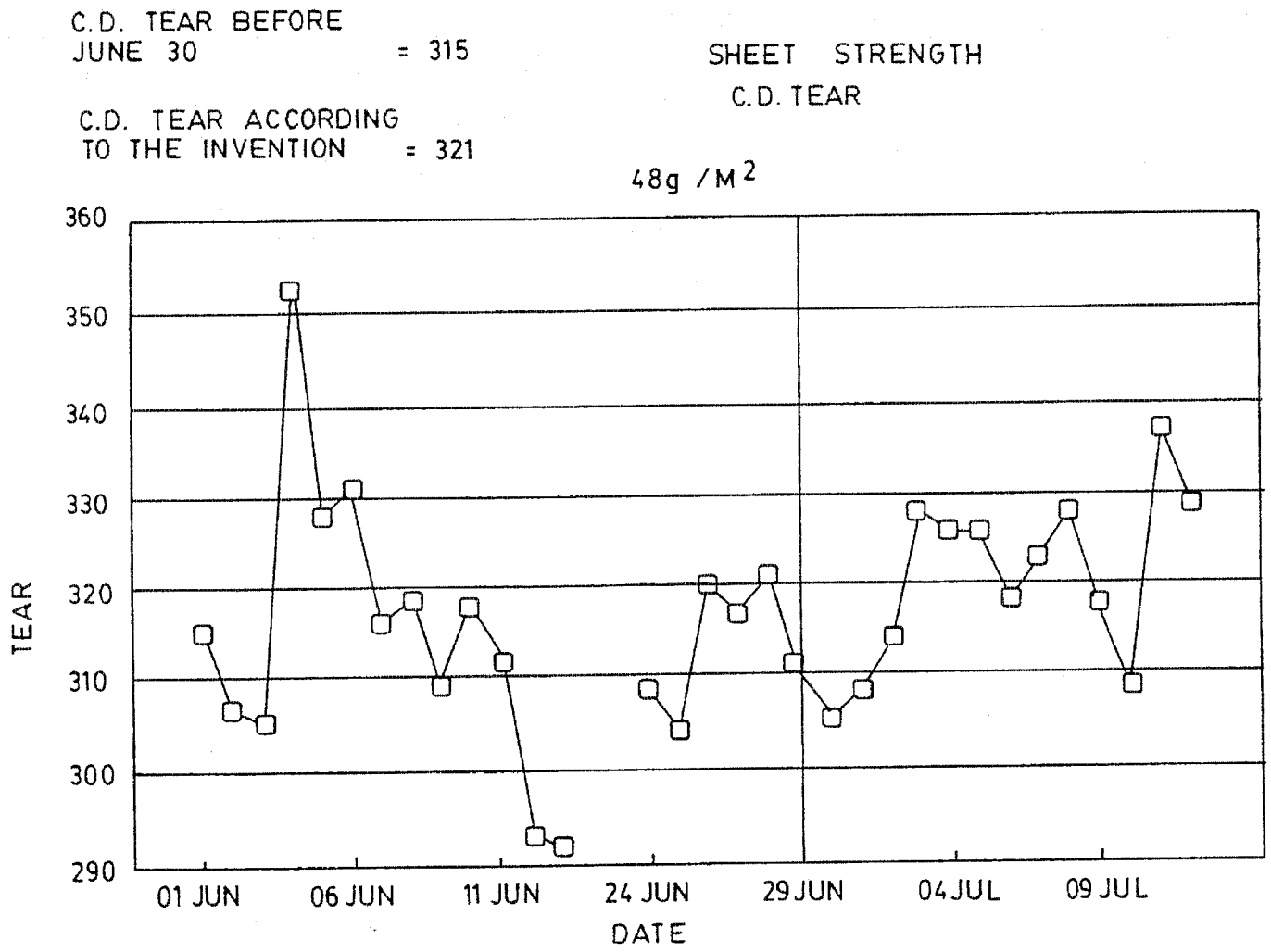
Figure 10:
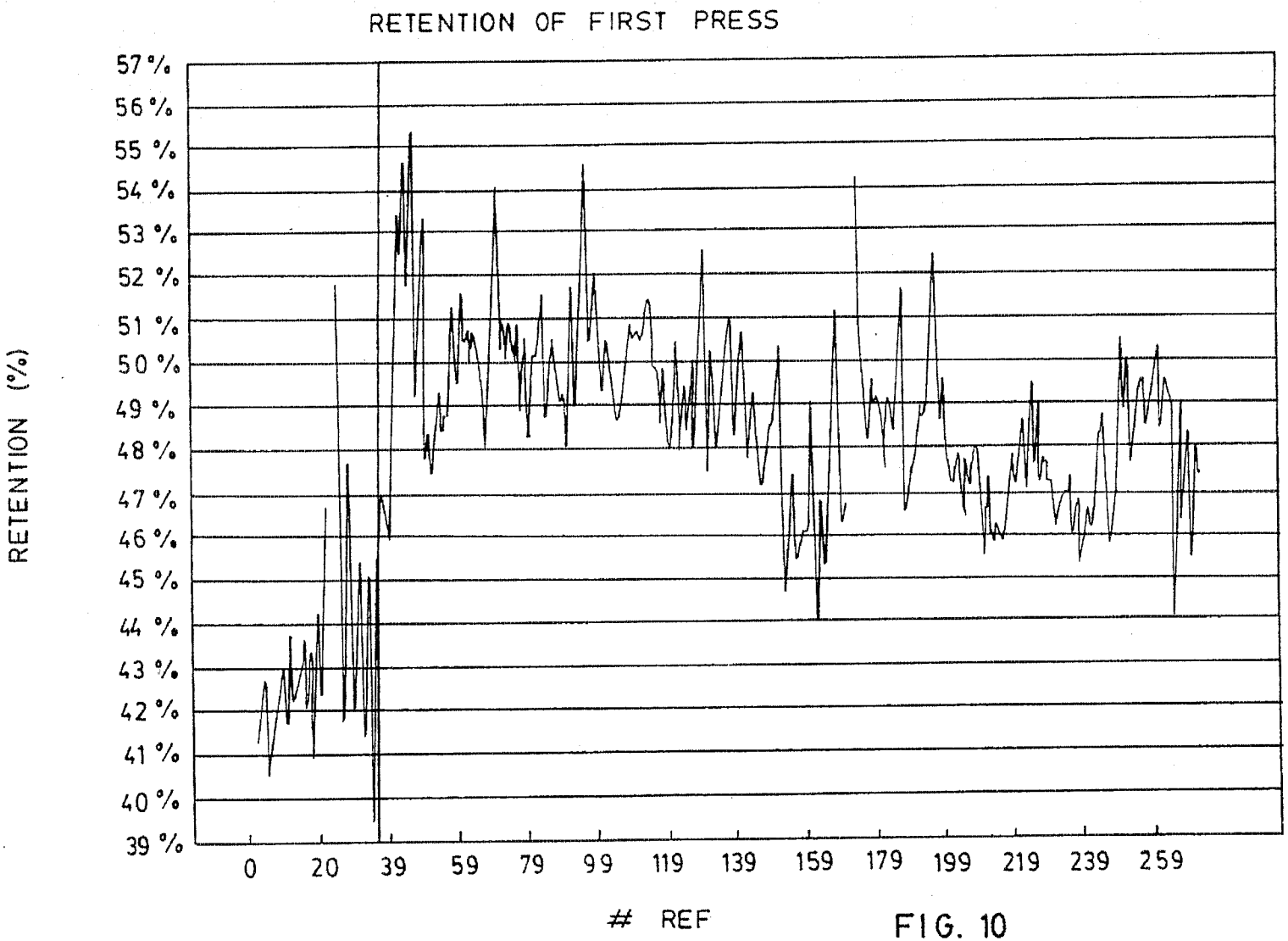
FIG. 10 shows retention of first press without and with a combined use of sodium naphthalene sulphonate and polyethylene oxide.
Figure 11:
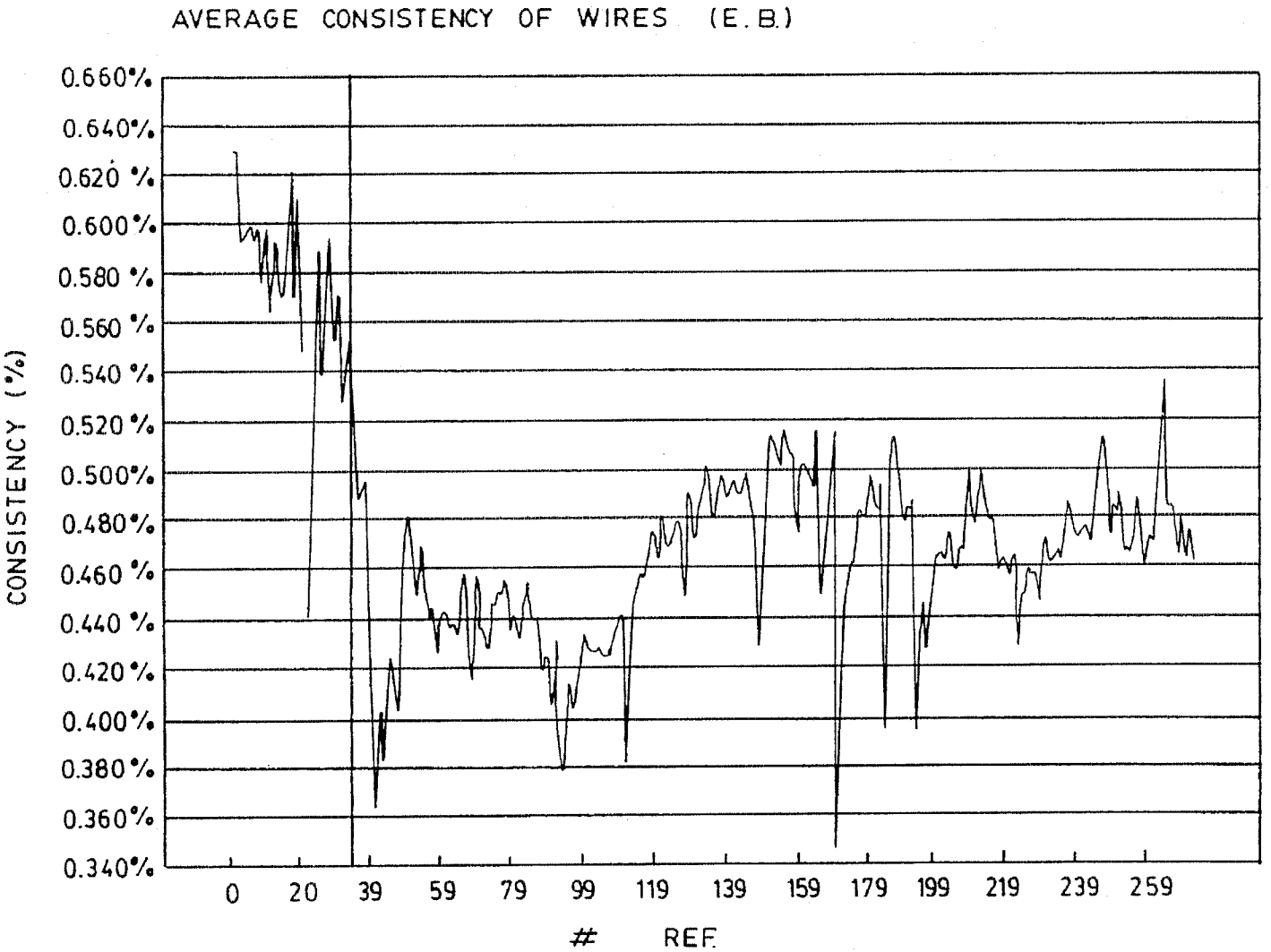
FIG. 11 shows average consistency of wire without and with a combined use of sodium naphthalene sulphonate and polyethylene oxide.
Figure 12:
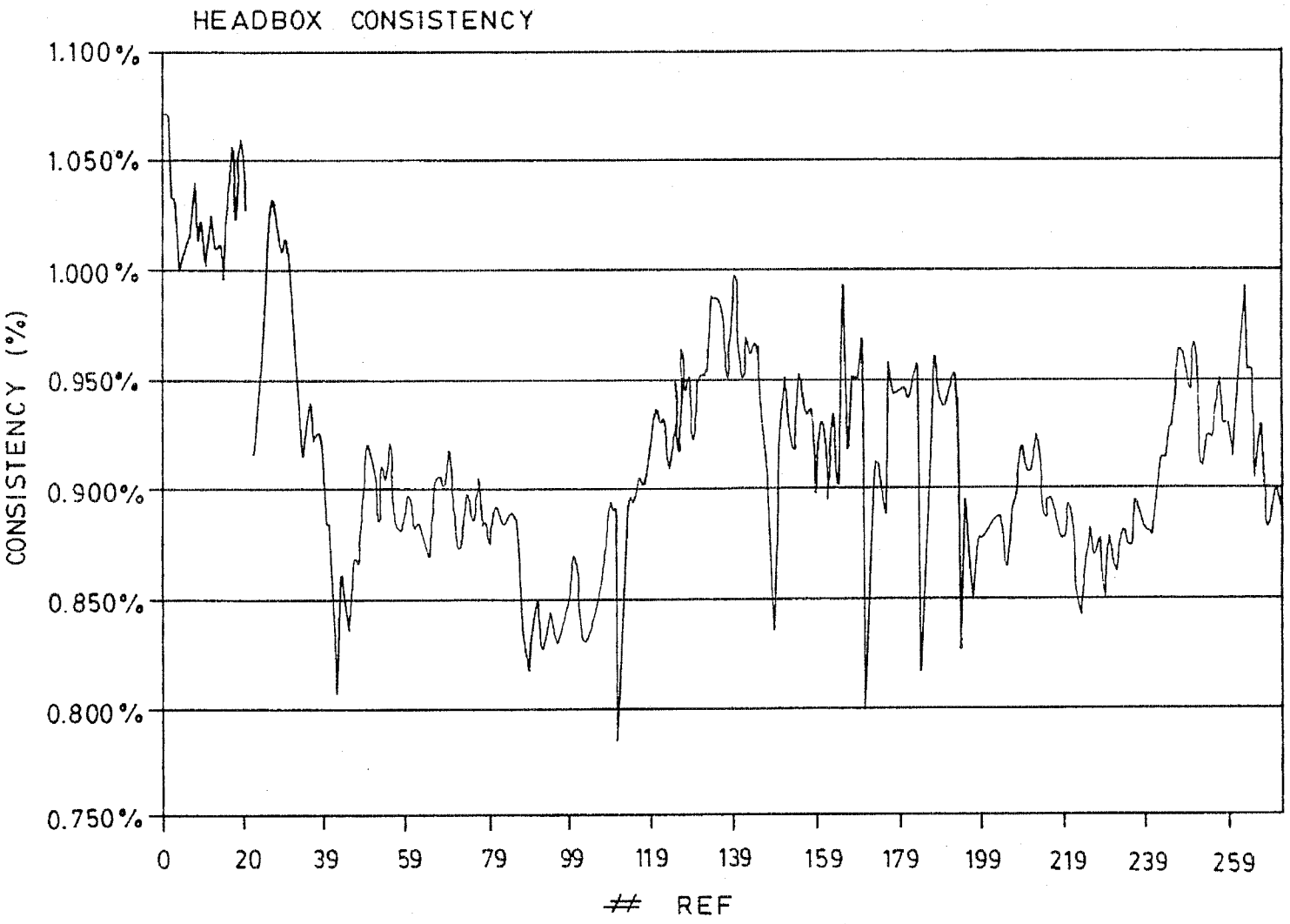
FIG. 12 shows head box consistency without and with a combined use of sodium naphthalene sulphonate and polyethylene oxide.
Figure 13:
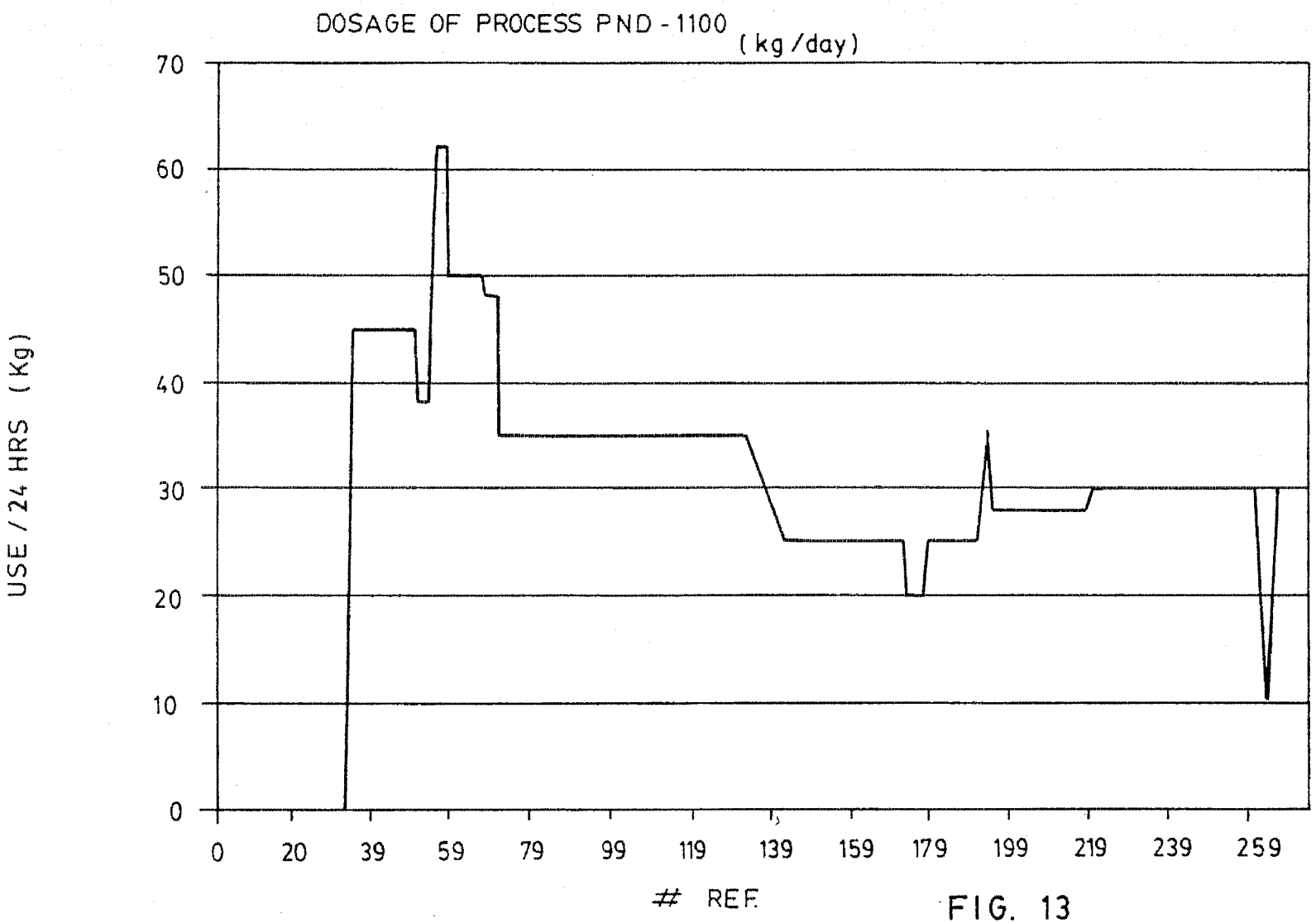
FIG. 13 shows dosage of process with polyethylene oxide.
Figure 14:
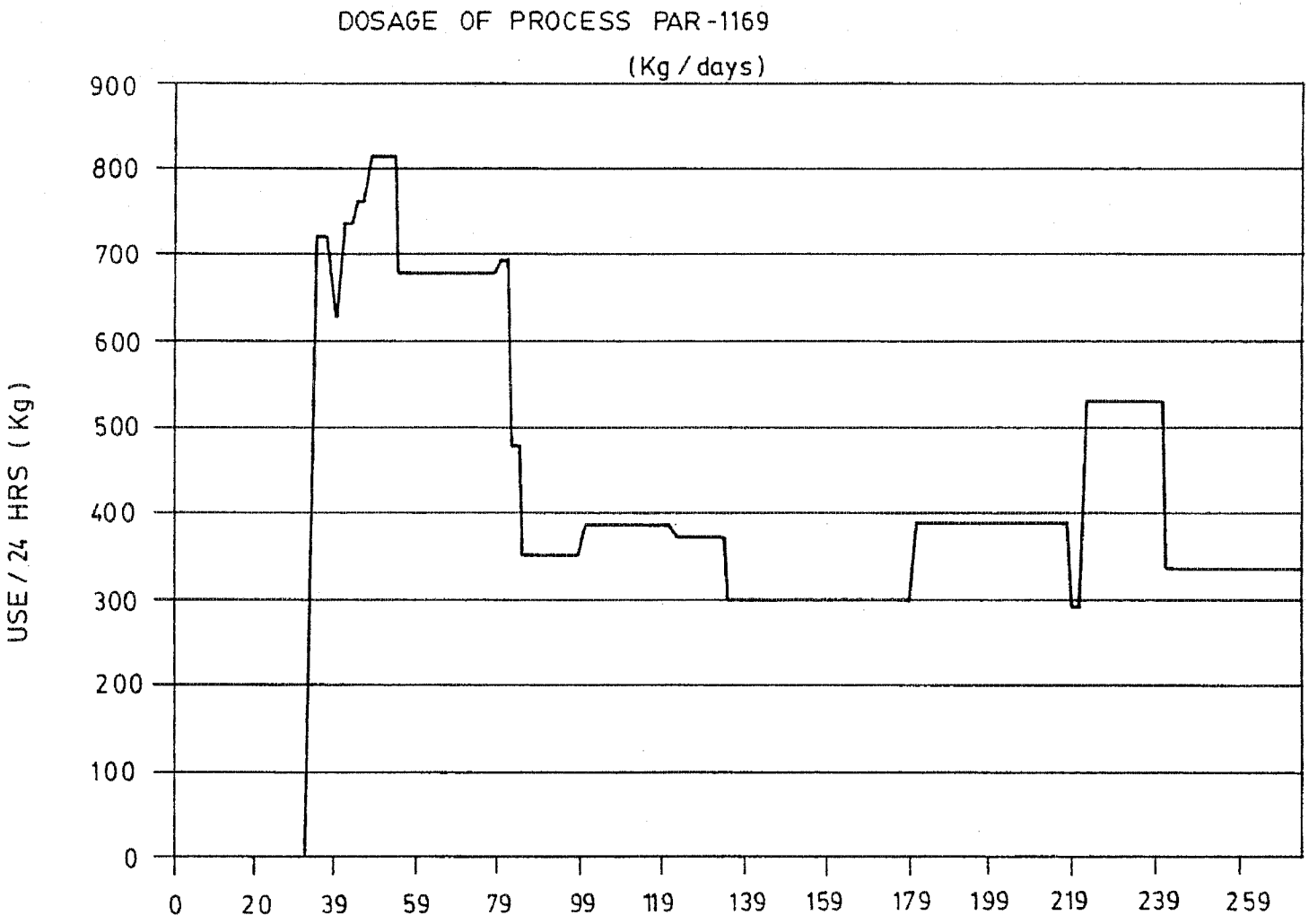
FIG. 14 shows dosage of process with sodium naphthalene sulphonate salt.
Figure 15:
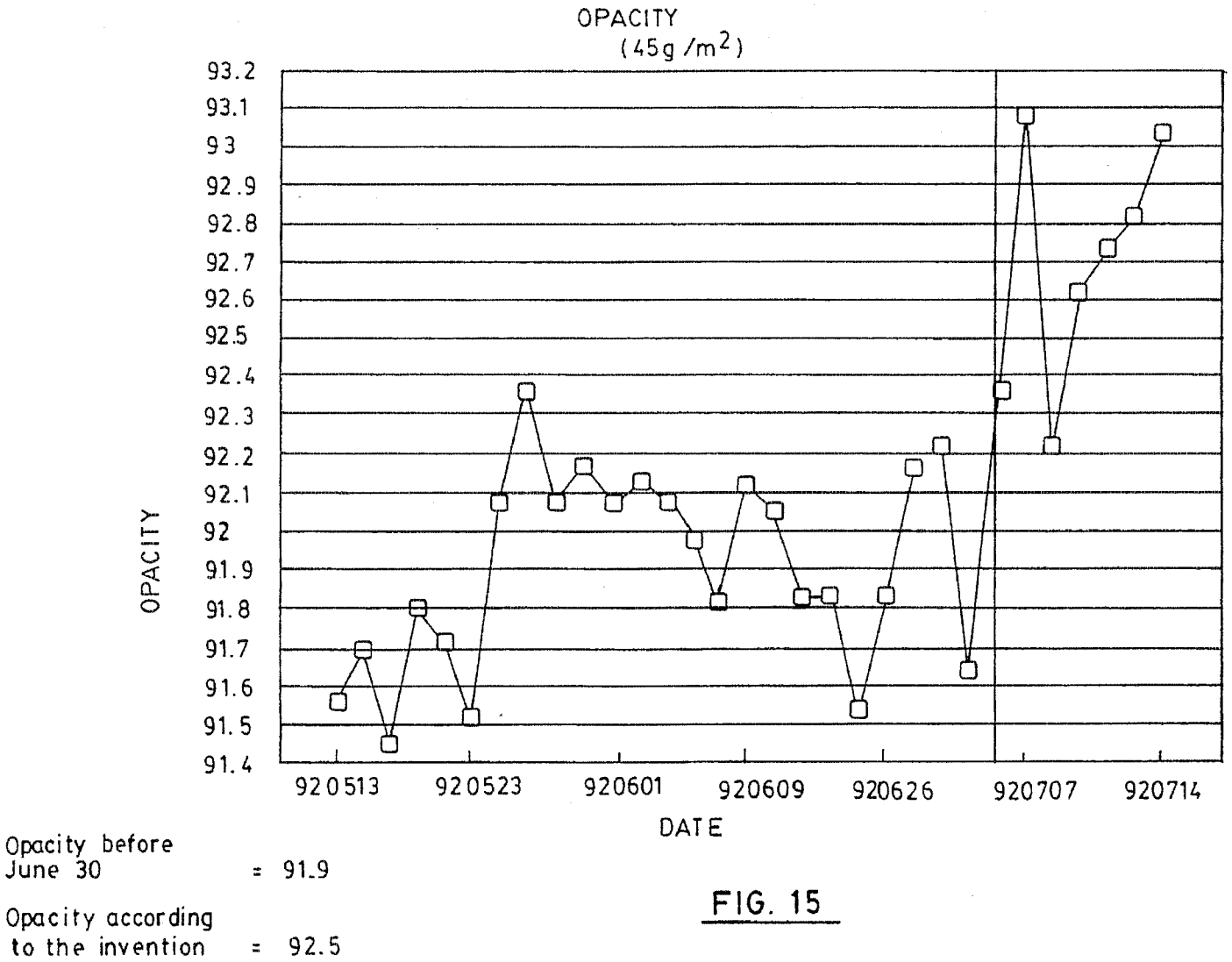
FIGS. 15 to 22 show opacity and whiteness without and with a combined use of sodium naphthalene sulphonate and polyethylene oxide.
Figure 16:
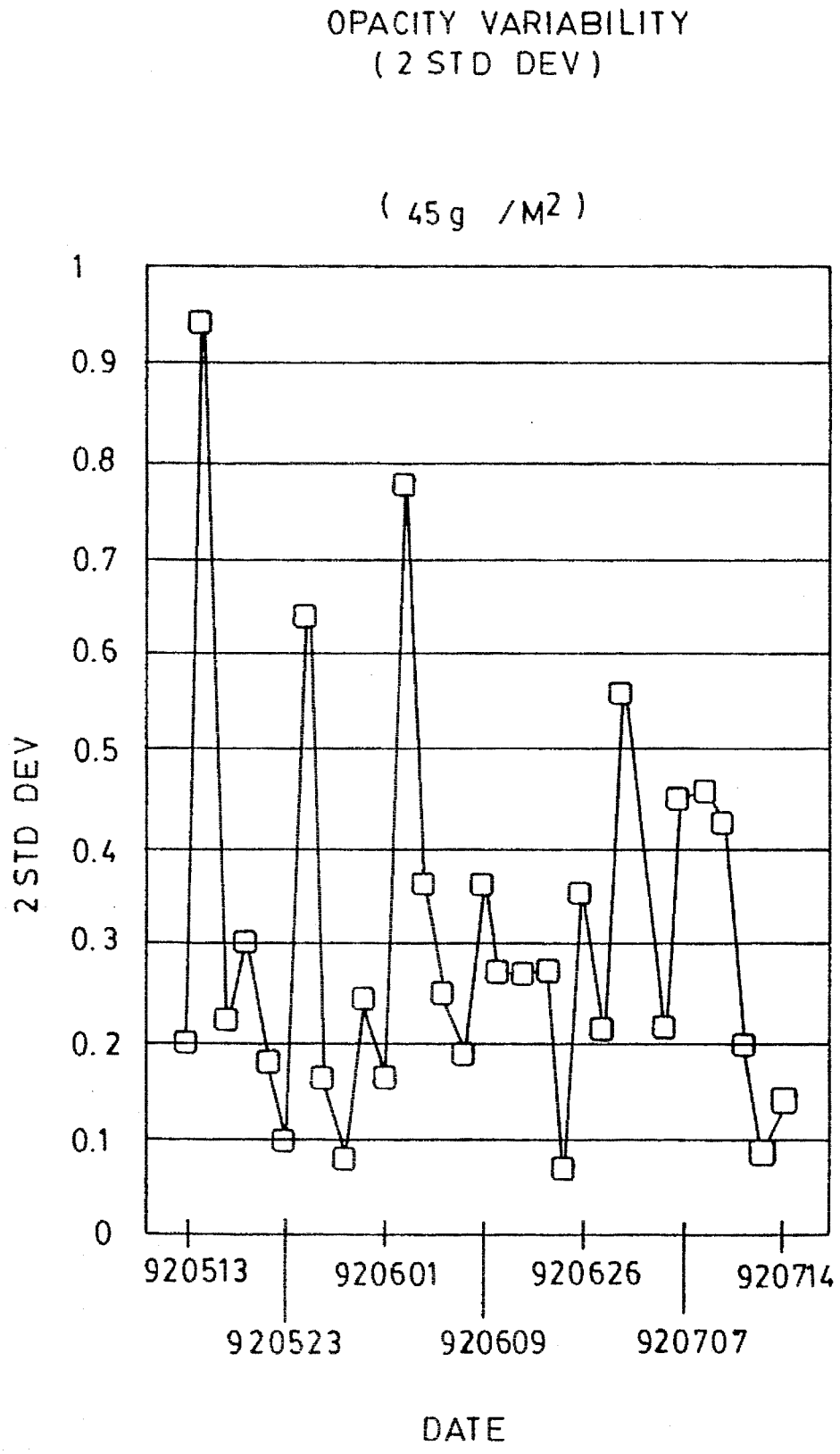
Figure 17:
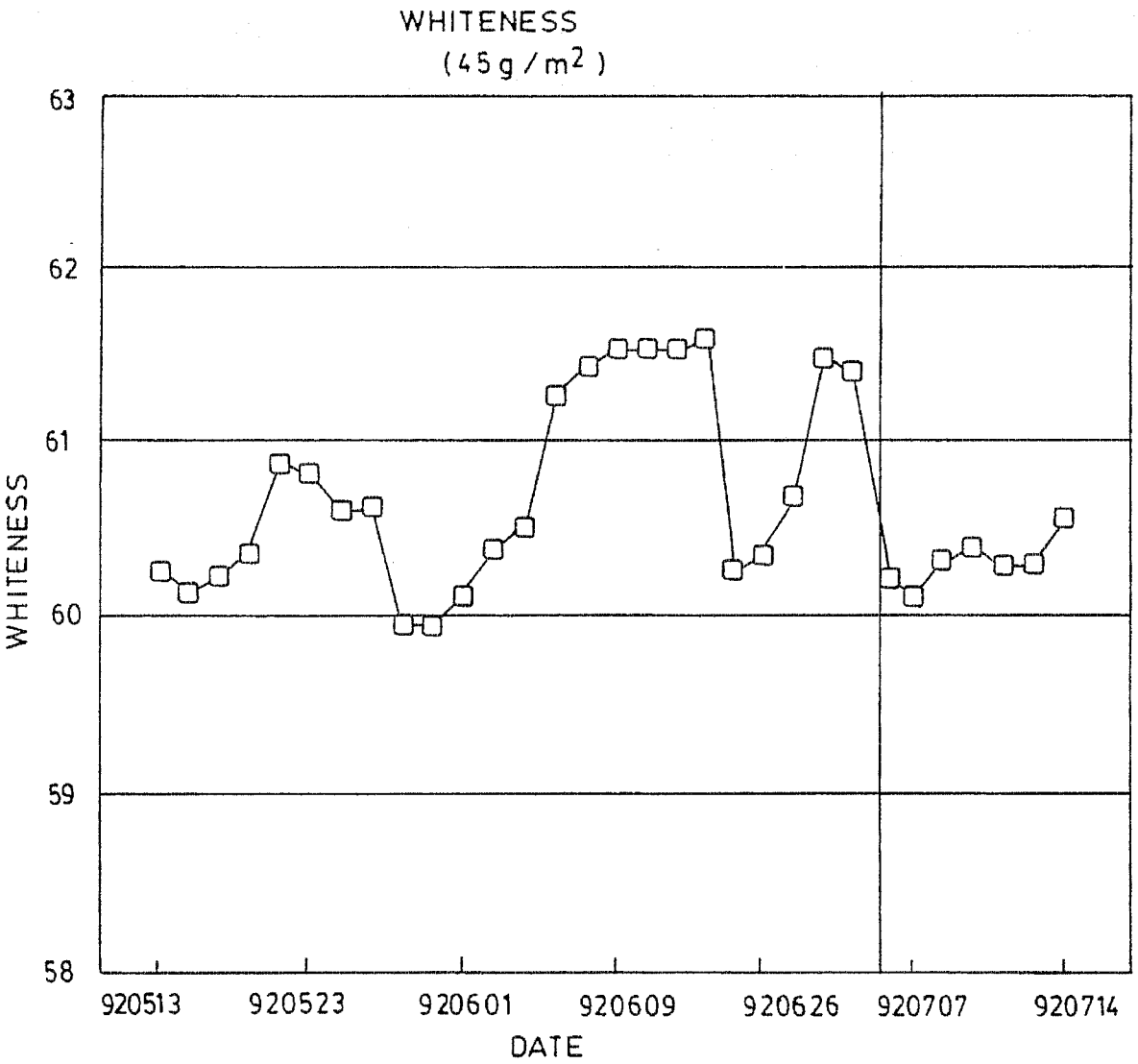
Figure 18:
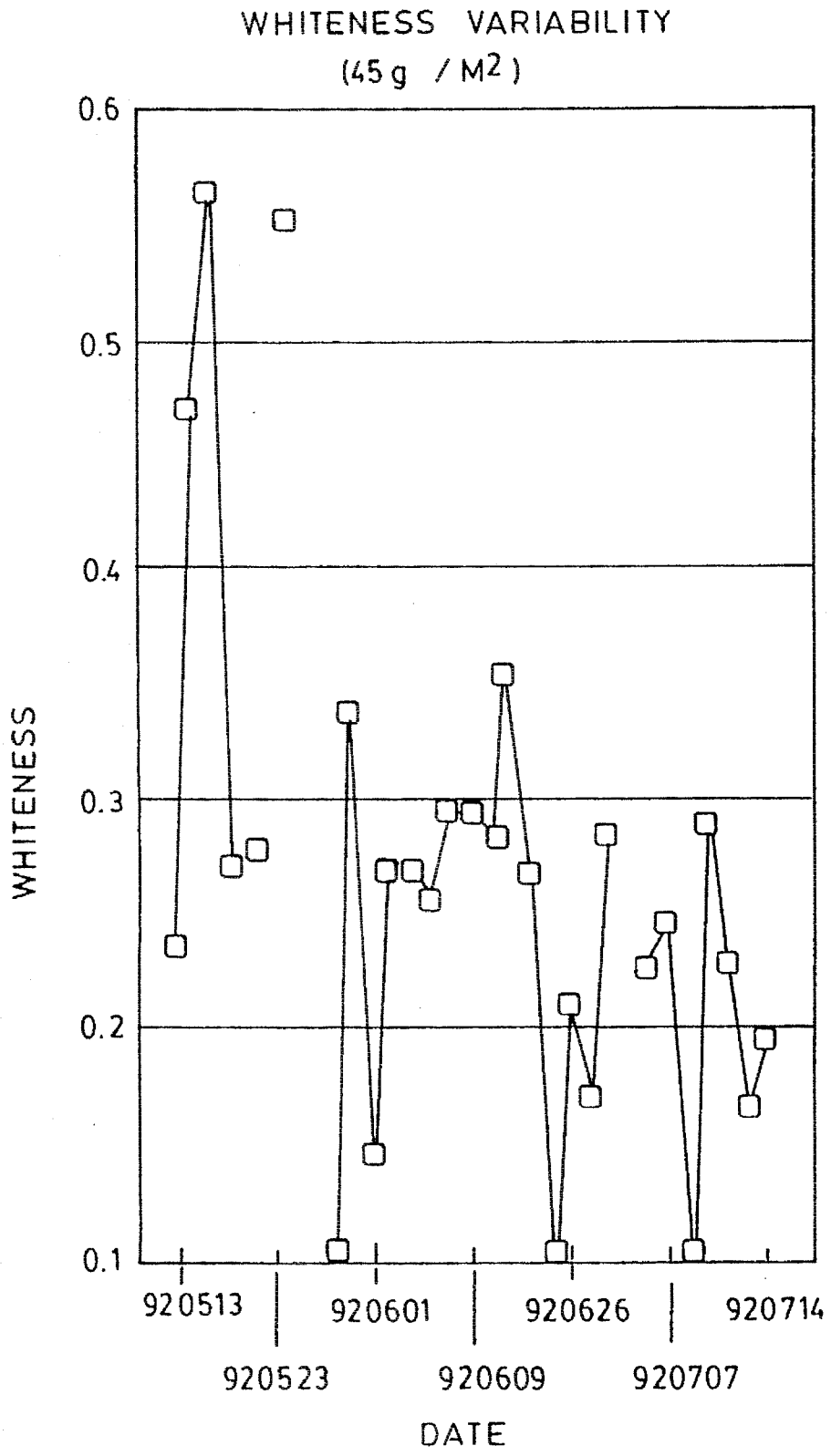
Figure 19:
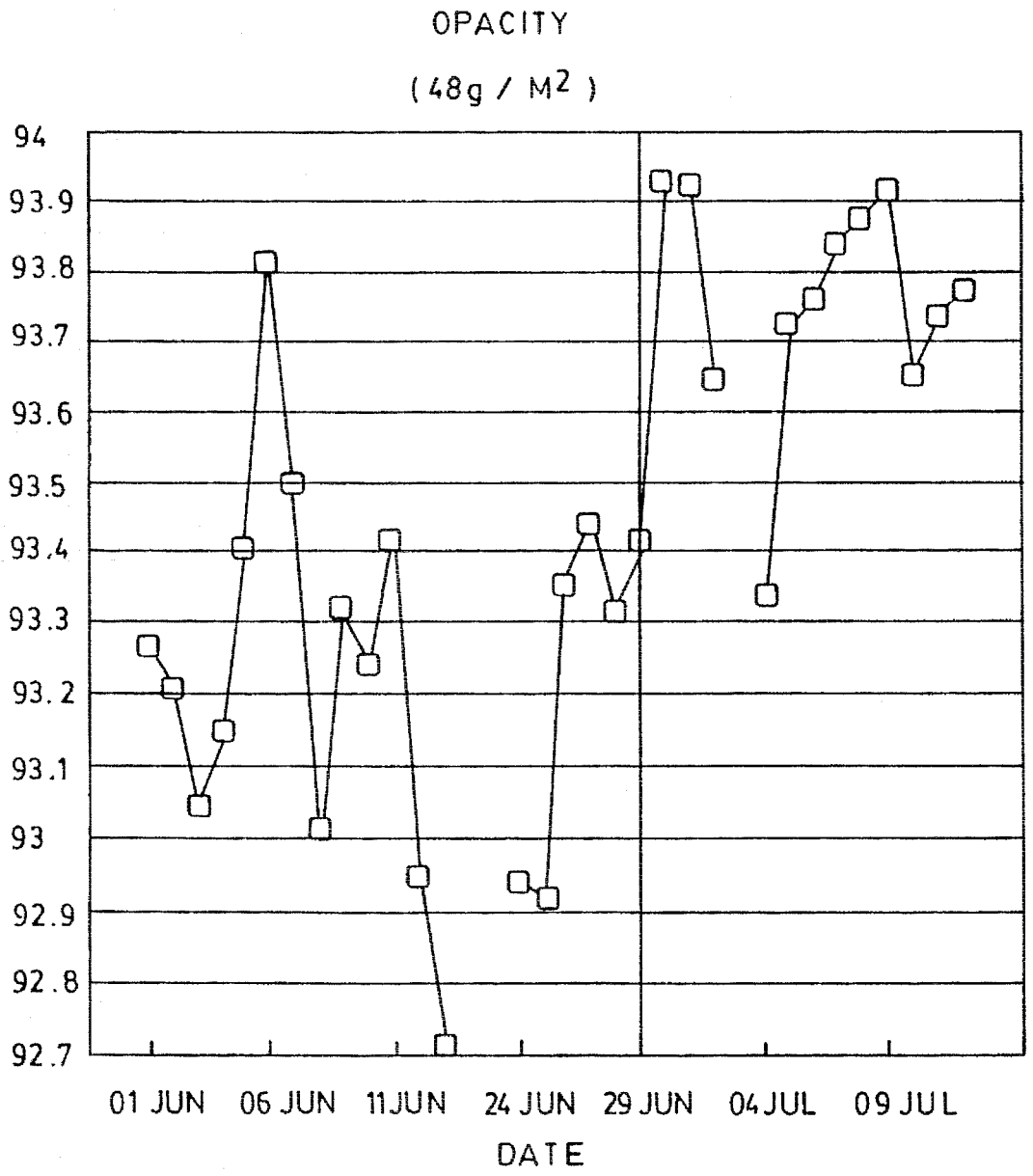
Figure 20:
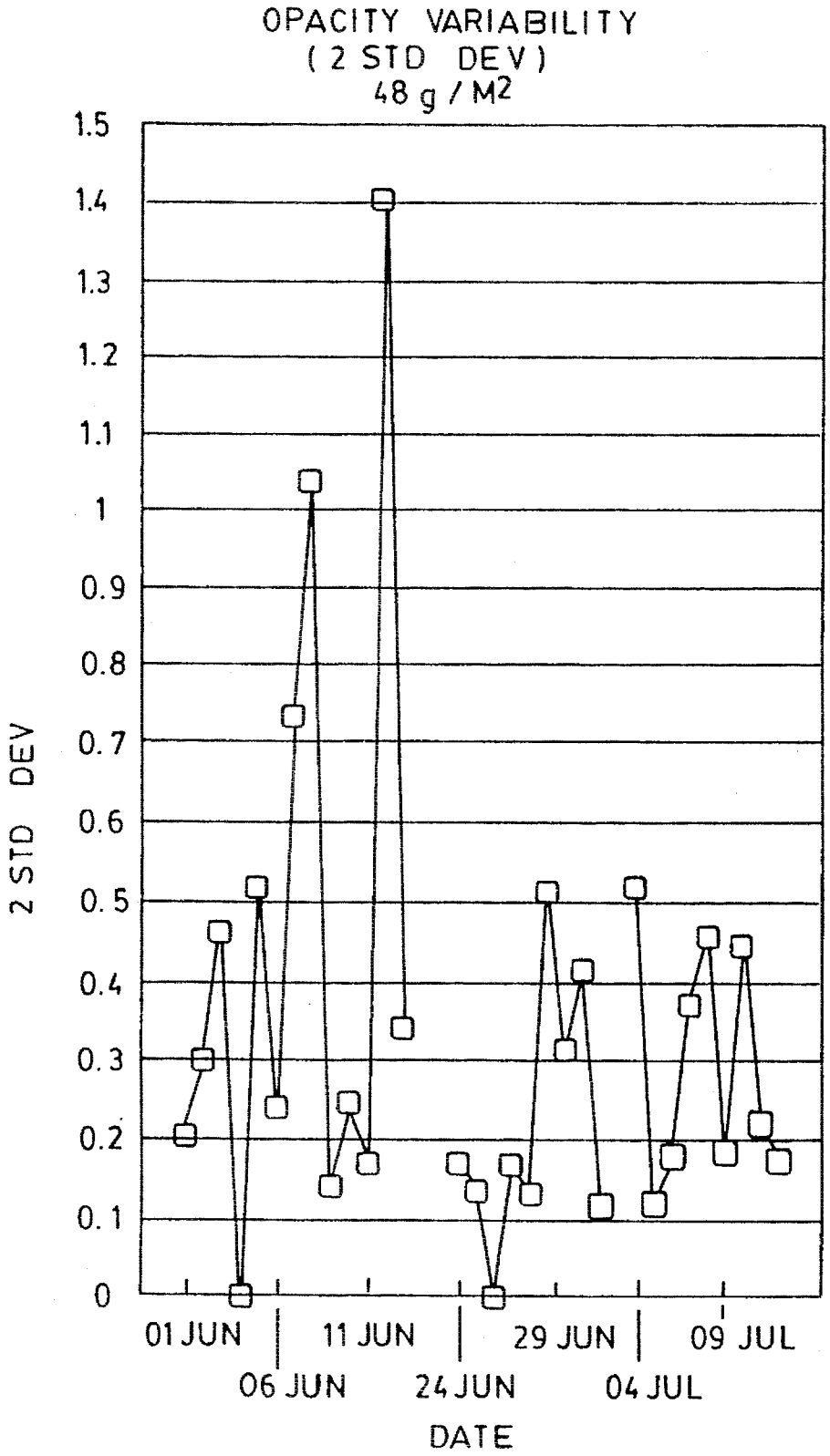
Figure 21:
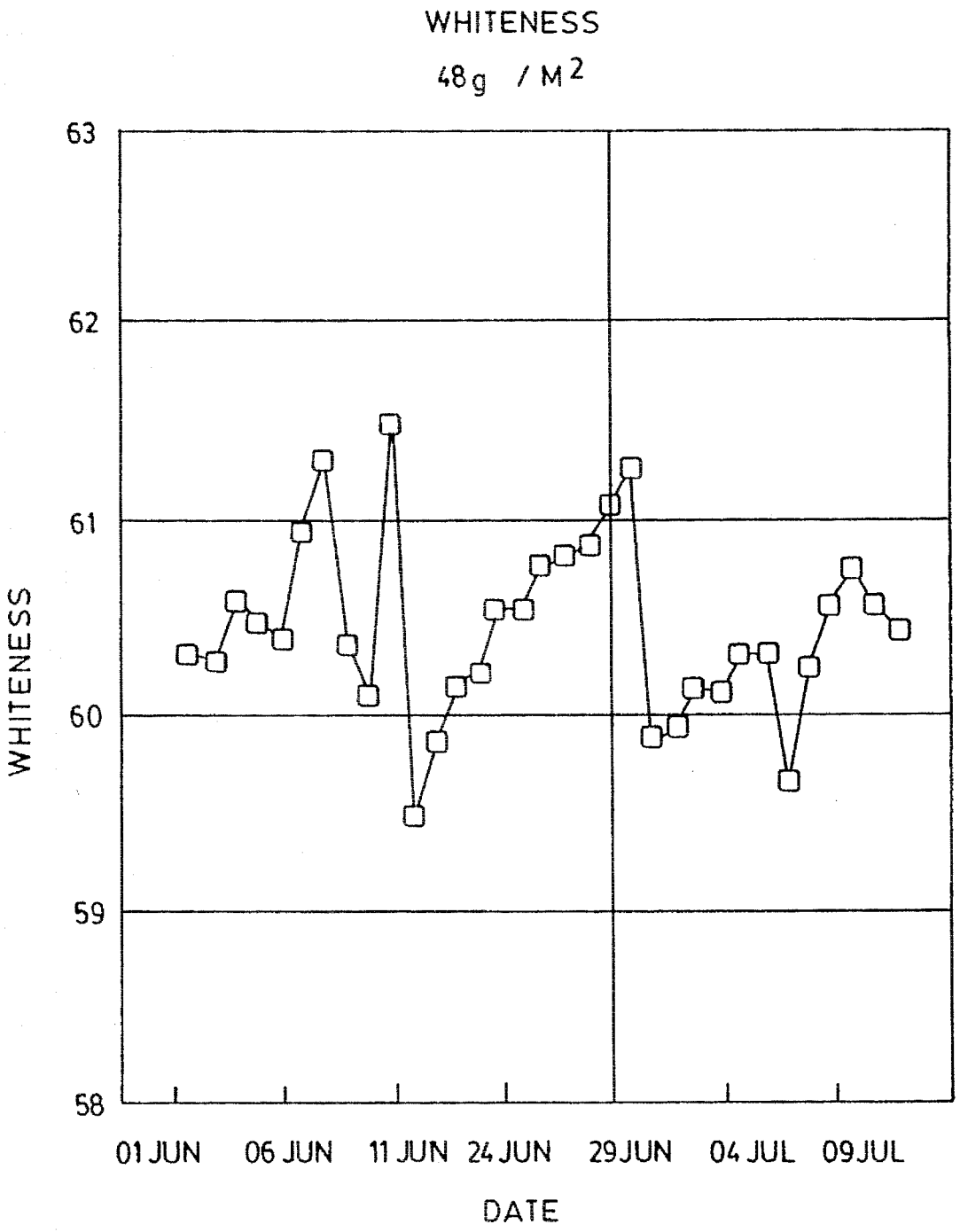
Figure 22:
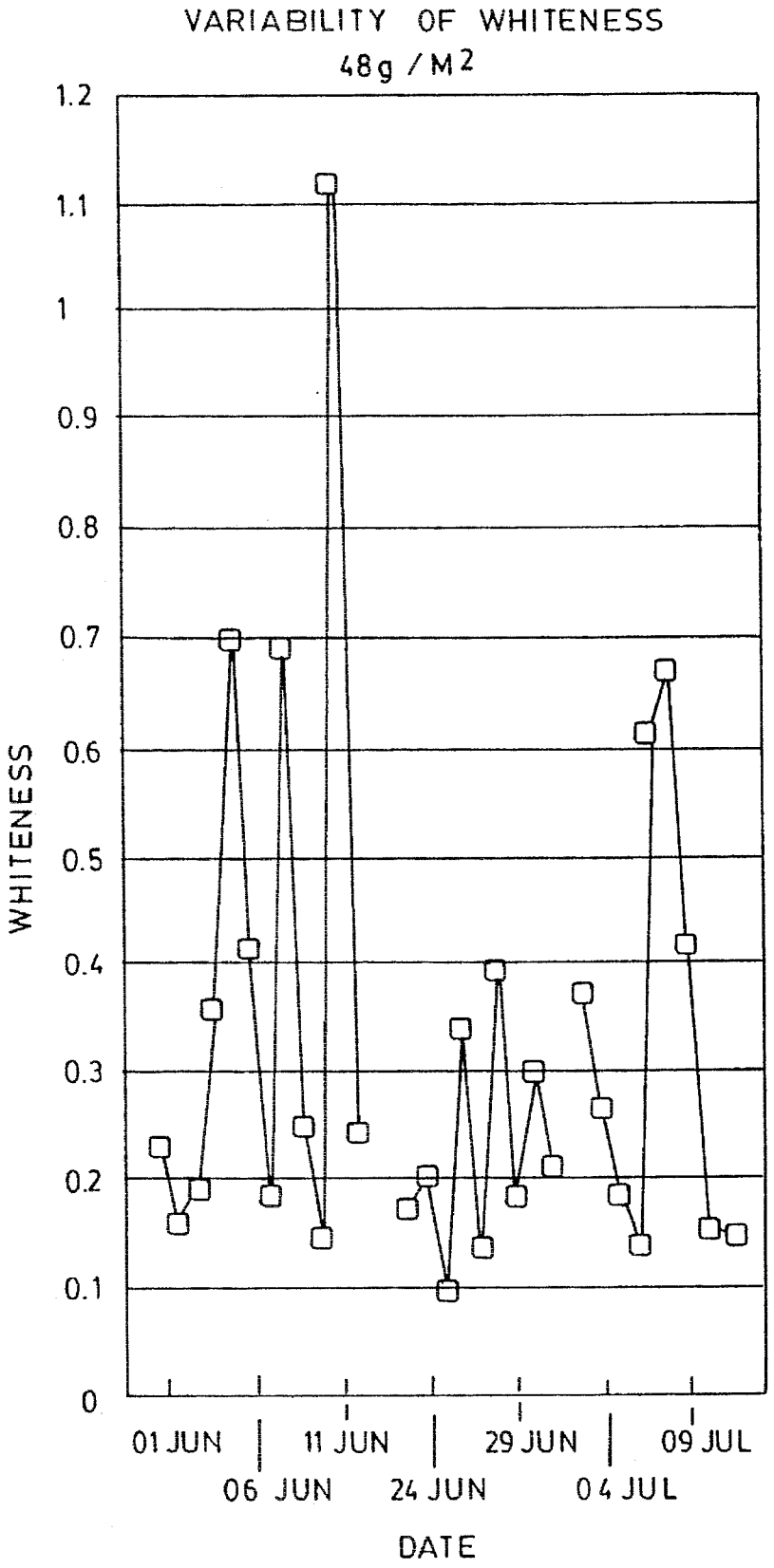
Figure 23:
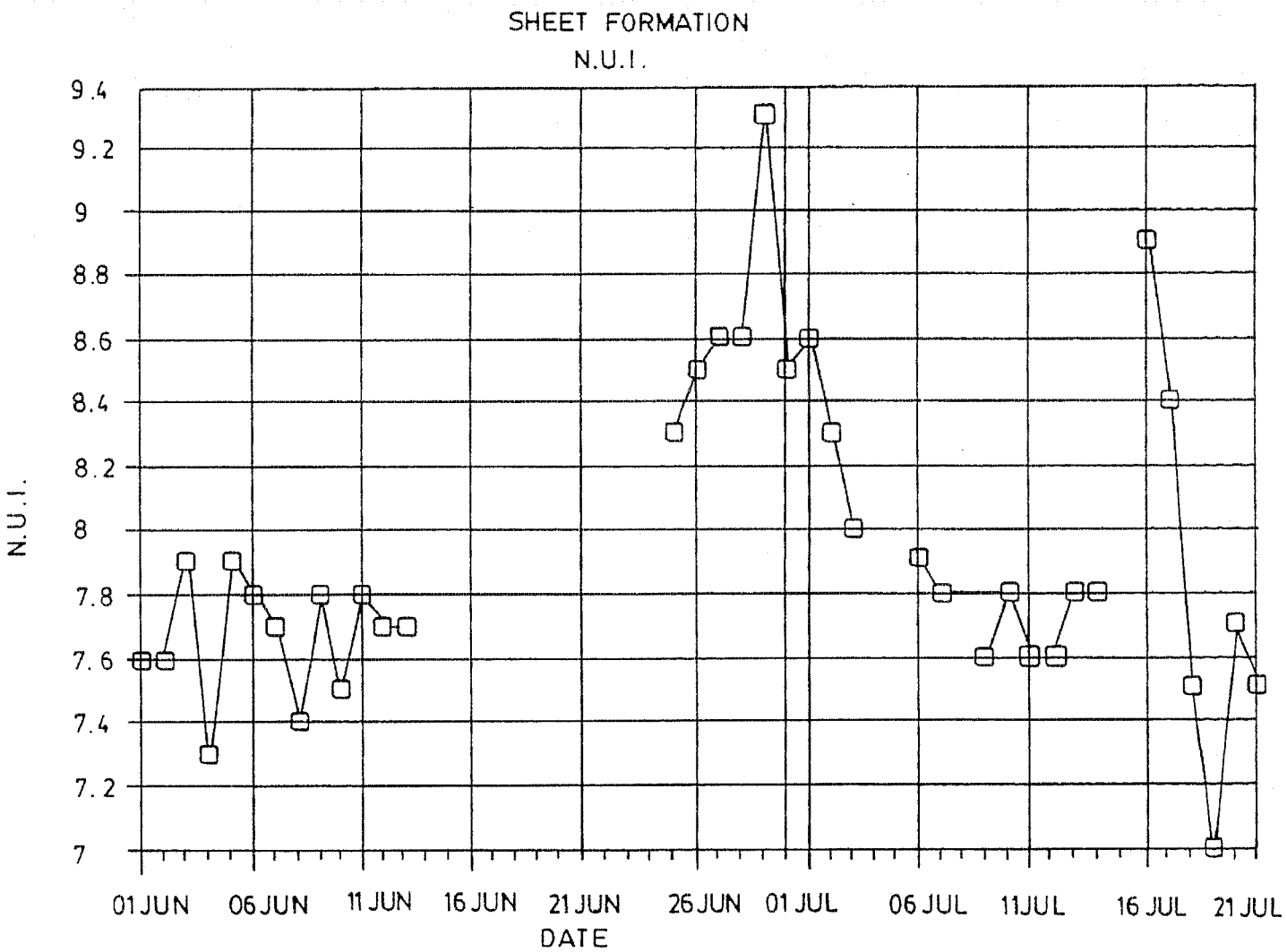
FIG. 23 shows a sheet formation without and with a combined use of sodium naphthalene sulphonate and polyethylene oxide.
Figure 24:
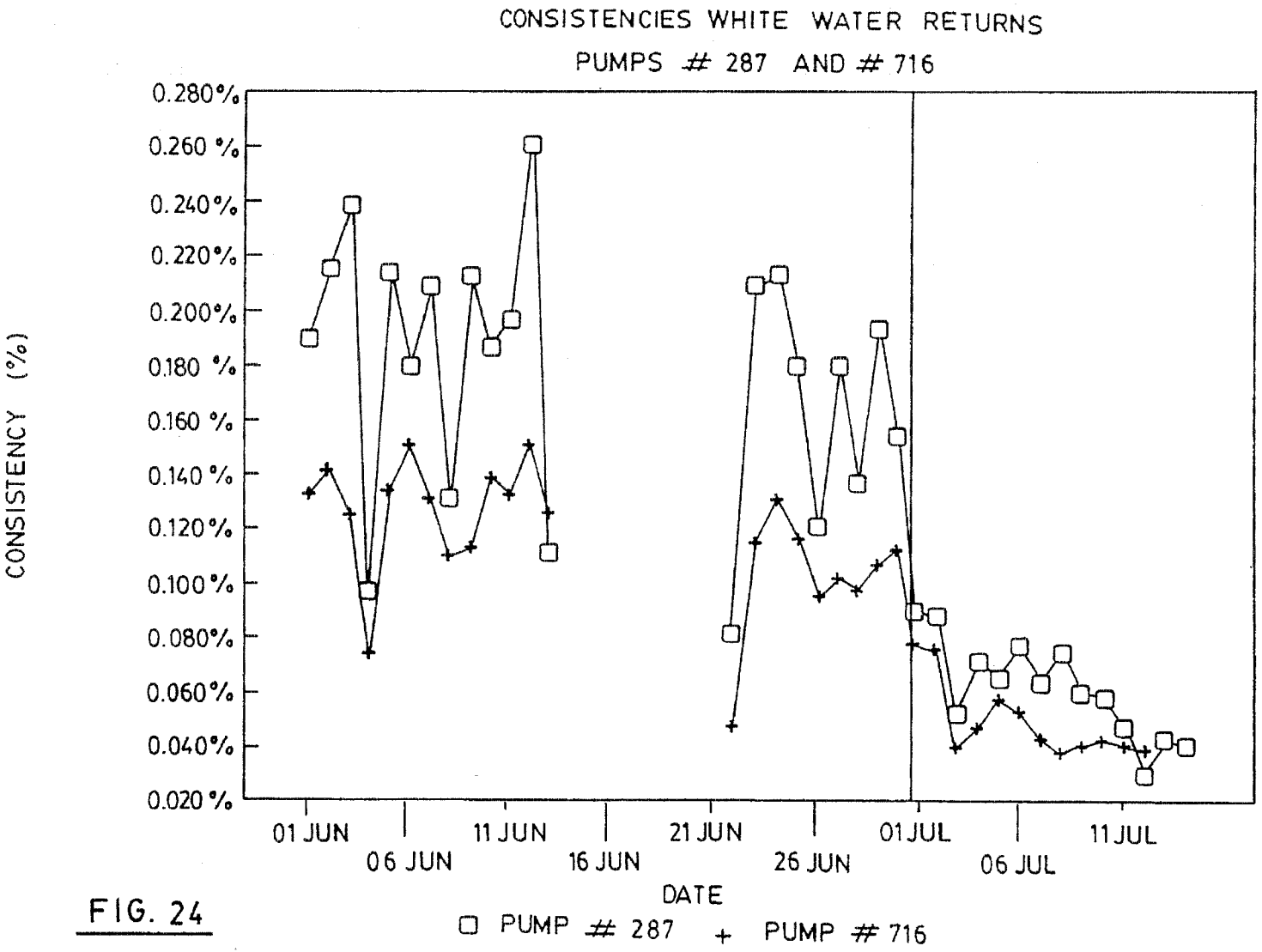
FIG. 24 shows consistencies of white water returns without and with a combined use of sodium naphthalene sulphonate and polyethylene oxide.
Figure 25:
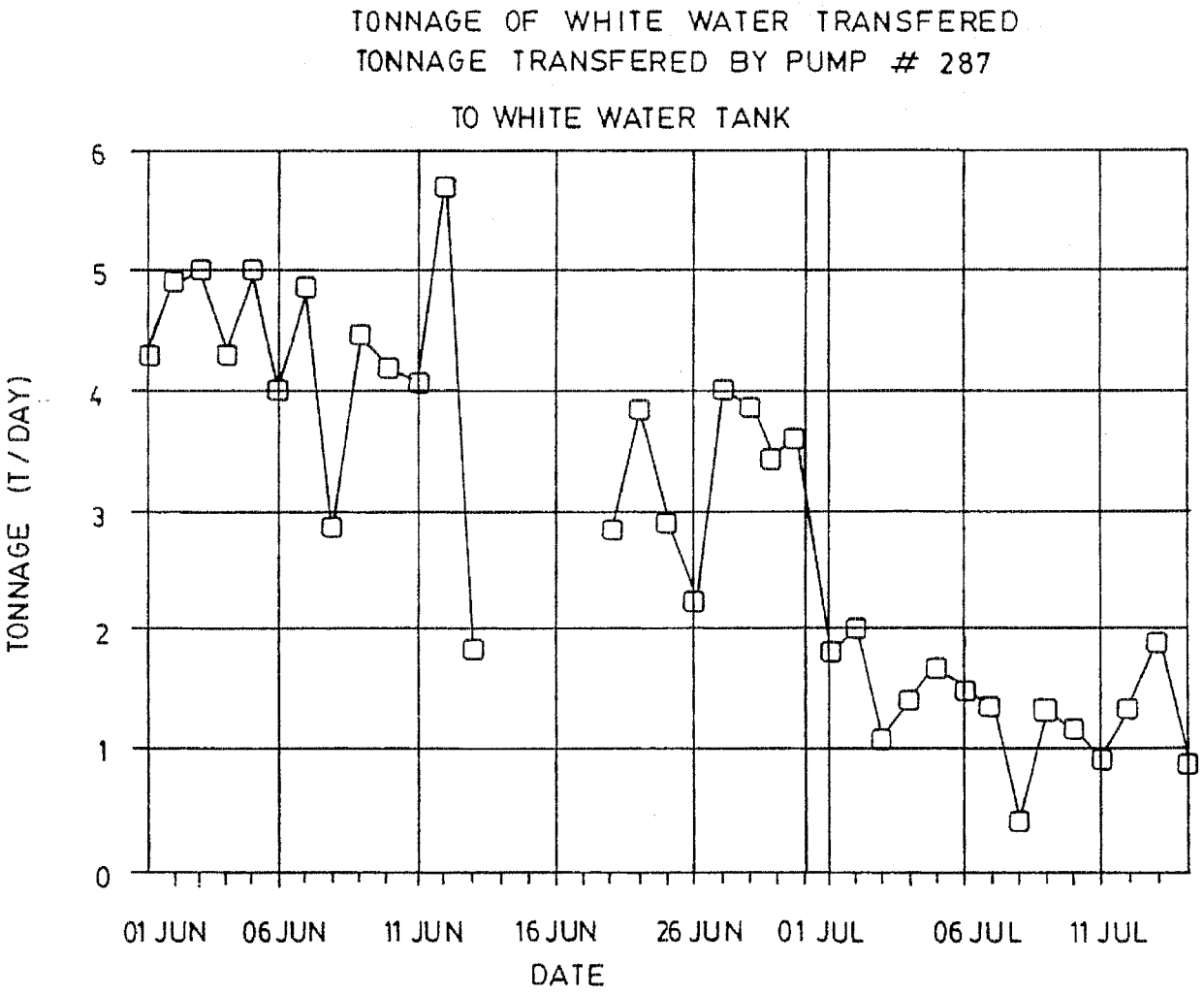
FIGS. 25 and 26 show tonnage of white water transferred without and with a combined use of sodium naphthalene sulphonate and polyethylene oxide.
Figure 26:
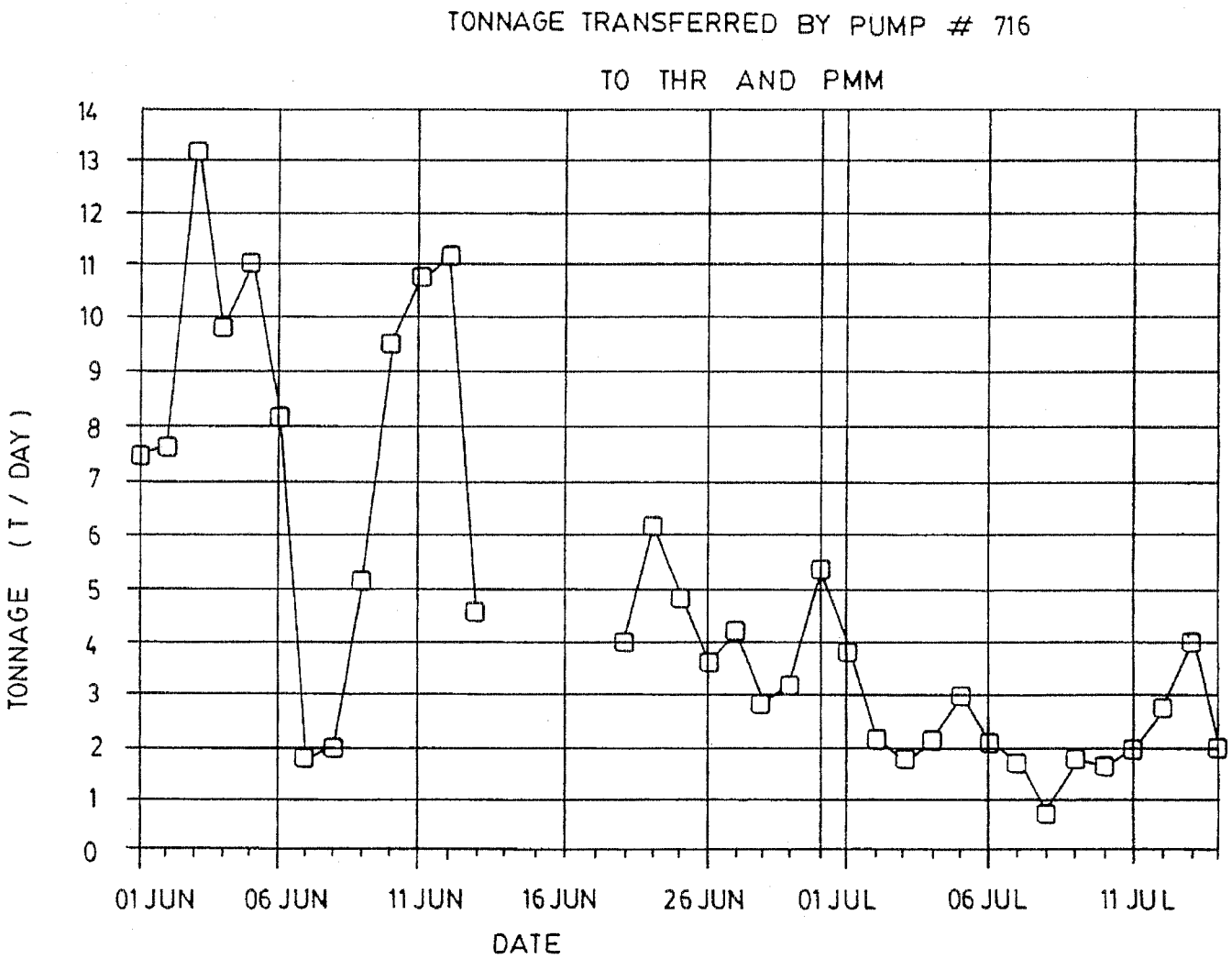
Figure 27:
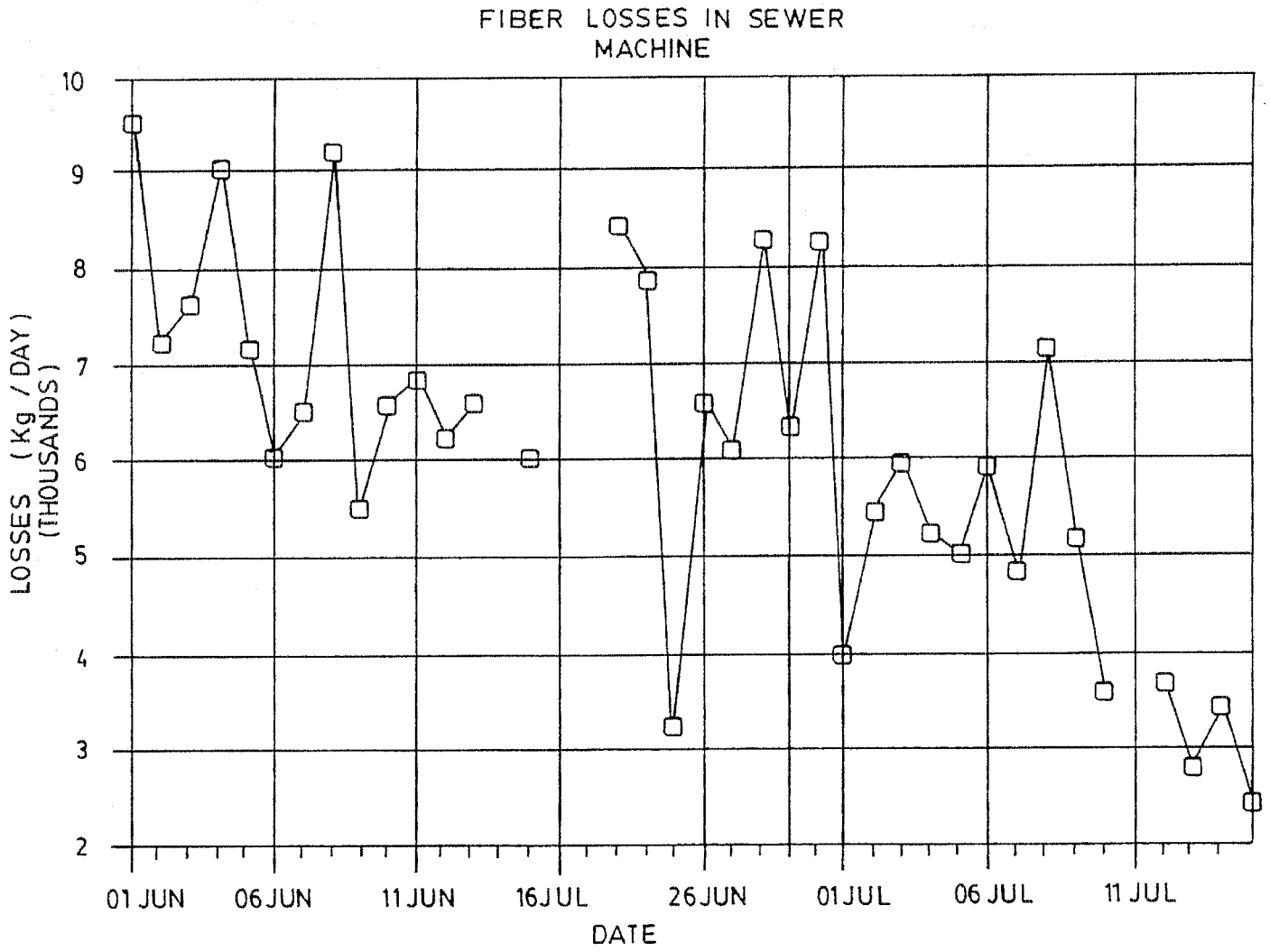
FIG. 27 shows fibre losses in sewer without and with a combined use of sodium naphthalene sulphonate and polyethylene oxide.
Figure 28:
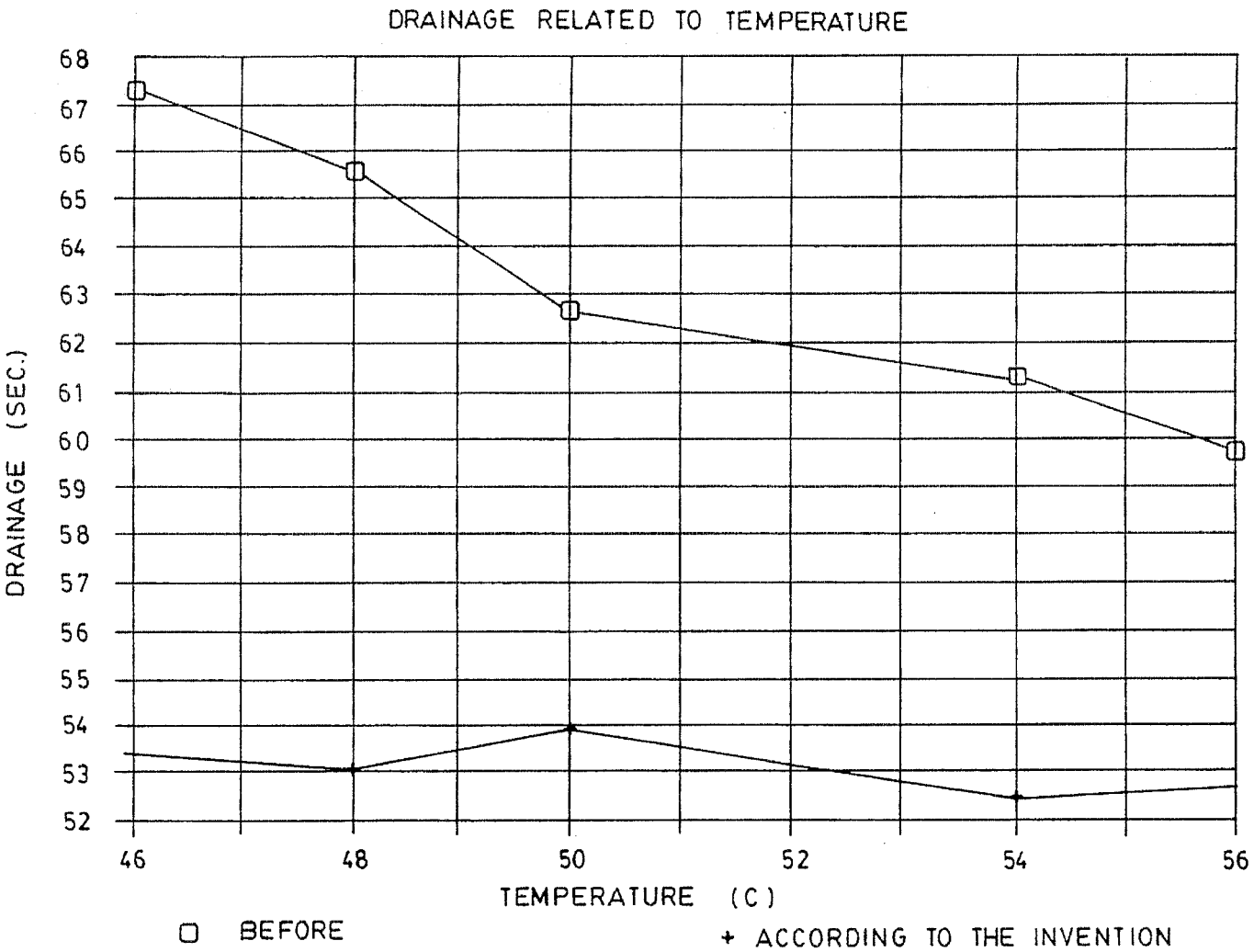
FIG. 28 shows drainage related to temperature without and with a combined use of sodium naphthalene sulphonate and polyethylene oxide.

FIGS. 1 to 28 show several variations obtained by using a combined use of a condensed solution of sodium naphthalene sulphonate salt (identified process par 1169) and a solution of a mix of polyethylene oxide having the aforesaid mean molecular weight (identified process PND 1100), in aforesaid example. In those figures, informations appearing at the left of a dark vertical line are without the use of naphthalene sulphonate salt(s) and polyethylene oxide, and information appearing at the right of the dark vertical line are according to the invention.

TABLE I

SUMMARY OF RESULTS

| ITEM | PRE-TRIAL | TRIAL | GAIN |
|---|---|---|---|
| Runnability | Good | Good | No change |
| Retention - 30 kg/day | 43.4% | 48.3% | +4.9% |
| - 40 kg/day | 43.4% | 50.4% | +7.0% |
| Opacity - 45 g/m$^2$ | 91.9 | 92.5 | +0.6 |
| - 48 g/m$^2$ | 93.2 | 93.8 | +0.6 |
| Brightness | 60.6 | 60.5 | −0.1 |
| Bleach consomption (kg/tonne) | 2.09 | 2.28 | 0.19 |
| Saveall | | | |
| - capacity | 15435 lpm | 20077 lpm | +4642 lpm |
| - cloudy cons. | 0.098% | 0.067% | −0.031% |
| - clear cons. | 0.087% | 0.050% | −0.037% |
| Pump 716 - consistance | 0.128% | 0.048% | −0.080% |
| - tonnage | 7.87 t/d | 2.48 t/d | −5.39 t/d |
| Steam usage - dryers | 23.5 t/hr | 2.48 t/td | −0.5 t/hr |
| - silo | 8.7 t/hr | 0 t/hr | −8.7 t/hr |
| Formation (N.U.I.) | 7.7 | 7.7 | 0* |
| Fiber loses | | | |
| - from p.m. | 7.6 t/d | 5.1 t/d | −2.5 t/d |
| - from mill | 17.4 t/d | 13.6 t/d | −3.8 t/d |
| - to river | 3.7 t/d | 3.0 t/d | −0.7 t/d |

*EXCEPT AT RETENTIONS OVER 54%

TABLE III

DOSAGE, RETENTION AND CONSISTENCIES

| DOSAGE 1100 kg/j | DOSAGE 1169 kg/j | RETENTION | CONSISTENCIES Toiles | CONSISTENCIES Head box |
|---|---|---|---|---|
| 0 | 0 | 43.4% | 0.57% | 1.01% |
| 30 | 300 | 48.3% | 0.47% | 0.91% |
| 40 | 400 | 50.4% | 0.43% | 0.87% |

TABLE IV

BRIGHTNESS OF FINES

SAMPLES TAKEN JULY 16, 1992

| | Paper | Headbox | Wires E.B. |
|---|---|---|---|
| BRIGHTNESS | 58.2 | 56.3 | 53.2 |
| A* | −0.48 | −0.09 | +0.18 |
| B* | 4.74 | 3.16 | 2.41 |

TABLE V

OPTIC CHARACTERISTICS

| CHARACTERISTICS | GRADE | BEFORE TRIAL AVG | BEFORE TRIAL 2 STD | ACCORDING TO THE INVENTION AVG | ACCORDING TO THE INVENTION 2 STD |
|---|---|---|---|---|---|
| Opacity | 48 g/m² | 93.2 | 0.36 | 93.8 | 0.29 |
| | 45 g/m² | 91.9 | 0.30 | 92.5 | 0.32 |
| Brightness | 48 g/m² | 60.5 | 0.33 | 60.3 | 0.30 |
| | 45 g/m² | 60.7 | 0.29 | 60.6 | 0.22 |

*The wire consistencies dropped from 0.57% to 0.43% and 2.5 t/d of fines were retained in the sheet rather than lost to the clarifier yet it only cost 0.44$/ton to recover the brightness loss.
Therefore, a 0.6 point tone opacity gain was achieved on both g/m² and 45 g/m²

TABLE IV

WHITEWATER MANAGEMENT

| | | PRE-TRIAL | POST OPTIMIZATION |
|---|---|---|---|
| Save-all | - capacity | 15435 1pm | 20077 |
| | - cloudy consistency | 0.098% | 0.067% |
| | - clear consistency | 0.087% | 0.050% |
| Pump 287 | - consistency | 0.188% | 0.061% |
| | - tonnage | 4.28 t/j | 1.49 t/j |
| Pump 716 | - consistency | 0.128% | 0.048% |
| | - tonage | 7.87 t/j | 2.48 t/j |

TABLE VII

FIBER LOSSES

| DATES | PAPER MACHINE SEWER (T/D) | CLARIFIER FEED (T/D) | CLARIFIER EFFLUENT (T/D) |
|---|---|---|---|
| 1–15 June | 7.6 | 17.4 | 3.7 |
| 23–29 June | 6.7* | 14.7* | 3.2* |
| 30–15 July | 5.1 | 13.5 | 3.0 |

*Clear white water after start-up.

TABLE VIII

STEAM MEASURES

| | PRE-TRIAL | ACCORDING TO THE INVENTION AFTER OPTIMIZATION |
|---|---|---|
| Silo temperature | 56° C. | 50.5° C. |
| Silo steam | 8.7 t/h | 0 t/h |
| Dryer steam | | |
| 45 g/m² | 20.4 t/h | 21.0 t/h |
| 48 g/m² | 23.5 t/h | 23 t/h |
| Total steam | | |
| 45 g/m² | 39.0 t/h | 30.0 t/h |
| 48 g/m² | 41.9 t/h | 34.7 t/h |
| Ton steam per ton paper | 2.07 | 1.76 |

CONISTENCY AND RETENTION ON MACHINE

| REF | DATE | HOUR | CONSISTANCIES HEAD BOX | CONSISTANCIES WIRE PIT | RETENTION | DOSAGES 1100 (Kg/J) | DOSAGES 1169 (Kg/J) |
|---|---|---|---|---|---|---|---|
| 0 | 16-May | | 1.070% | 0.628% | 41.3% | 0 | 0 |
| 1 | 17-May | | 1.072% | 0.630% | 41.2% | 0 | 0 |
| 2 | 18-May | | 1.037% | 0.597% | 42.4% | 0 | 0 |
| 3 | 19-May | | 1.034% | 0.592% | 42.7% | 0 | 0 |
| 4 | 20-May | | 1.000% | 0.595% | 40.5% | 0 | 0 |
| 5 | 21-May | | 1.010% | 0.600% | 40.6% | 0 | 0 |
| 6 | 22-May | | 1.016% | 0.592% | 41.7% | 0 | 0 |
| 7 | 23-May | | 1.040% | 0.600% | 42.3% | 0 | 0 |
| 8 | 24-May | | 1.014% | 0.577% | 43.1% | 0 | 0 |
| 9 | 25-May | | 1.024% | 0.597% | 41.7% | 0 | 0 |
| 10 | 26-May | | 1.000% | 0.563% | 43.7% | 0 | 0 |
| 11 | 27-May | | 1.010% | 0.584% | 42.2% | 0 | 0 |
| 12 | 01-Jun | | 1.028% | 0.592% | 42.4% | 0 | 0 |
| 13 | 02-Jun | | 1.008% | 0.575% | 43.0% | 0 | 0 |
| 14 | 03-Jun | | 1.012% | 0.570% | 43.7% | 0 | 0 |
| 15 | 05-Jun | | 0.993% | 0.575% | 42.1% | 0 | 0 |

-continued

| | | | | | | | |
|---|---|---|---|---|---|---|---|
| 16 | 06-Jun | | 1.037% | 0.589% | 43.2% | 0 | 0 |
| 17 | 07-Jun | | 1.055% | 0.625% | 40.8% | 0 | 0 |
| 18 | 10-Jun | | 1.023% | 0.570% | 44.3% | 0 | 0 |
| 19 | 11-Jun | | 1.058% | 0.610% | 42.3% | 0 | 0 |
| 20 | 12-Jun | | 1.027% | 0.547% | 46.7% | 0 | 0 |
| | | STOP | | | | | |
| 21 | 23-Jun | 08:45 AM | 0.916% | 0.441% | 51.9% | 0 | 0 |
| 22 | | 11:36 AM | 0.934% | 0.470% | 49.7% | 0 | 0 |
| 23 | | 01:28 AM | 0.964% | 0.499% | 48.2% | 0 | 0 |
| 24 | 24-Jun | 08:27 AM | 1.013% | 0.590% | 41.8% | 0 | 0 |
| 25 | | 11:07 AM | 1.029% | 0.538% | 47.7% | 0 | 0 |
| 26 | | 01:19 AM | 1.034% | 0.557% | 46.1% | 0 | 0 |
| 27 | 25-Jun | 08:36 AM | 1.023% | 0.594% | 41.9% | 0 | 0 |
| 28 | | 10:42 AM | 1.008% | 0.564% | 44.0% | 0 | 0 |
| 29 | | 02:18 AM | 1.013% | 0.553% | 45.4% | 0 | 0 |
| 30 | 26-Jun | 01:36 AM | 0.976% | 0.573% | 41.3% | 0 | 0 |
| 31 | | 10:06 AM | 0.958% | 0.527% | 45.0% | 0 | 0 |
| 32 | | 08:54 AM | 0.936% | 0.537% | 42.6% | 0 | 0 |
| 33 | 29-Jun | 01:56 AM | 0.912% | 0.554% | 39.3% | 0 | 0 |
| 34 | 29-Jun | 02:00 AM | 0.922% | 0.501% | 45.7% | 45 | 721 |
| 35 | | 02:30 AM | 0.940% | 0.502% | 46.6% | 45 | 721 |
| 36 | | 03:00 AM | 0.922% | 0.488% | 47.1% | 45 | 691 |
| 37 | | 03:30 AM | 0.926% | 0.493% | 46.8% | 45 | 655 |
| 38 | | 04:30 PM | 0.920% | 0.497% | 46.0% | 45 | 620 |
| 39 | | 08:30 PM | 0.884% | 0.412% | 53.4% | 45 | 735 |
| 40 | | 09:00 PM | 0.884% | 0.420% | 52.5% | 45 | 735 |
| 41 | | 10:30 PM | 0.804% | 0.364% | 54.7% | 45 | 735 |
| 42 | | 11:50 PM | 0.836% | 0.404% | 51.7% | 45 | 735 |
| 43 | 30-Jun | 12:30 AM | 0.860% | 0.384% | 55.3% | 45 | 762 |
| 44 | | 01:30 AM | 0.844% | 0.408% | 51.7% | 45 | 762 |
| 45 | | 02:30 AM | 0.836% | 0.424% | 49.3% | 45 | 762 |
| 46 | | 03:24 AM | 0.868% | 0.416% | 52.1% | 45 | 811 |
| 47 | | 04:30 AM | 0.864% | 0.404% | 53.2% | 45 | 811 |
| 48 | | 08:00 AM | 0.880% | 0.460% | 47.7% | 45 | 811 |
| 49 | | 09:30 AM | 0.920% | 0.476% | 48.3% | 45 | 811 |
| 50 | | 10:30 AM | 0.912% | 0.480% | 47.4% | 45 | 811 |
| 51 | | 11:30 AM | 0.904% | 0.468% | 48.2% | 38 | 811 |
| 52 | | 01:48 PM | 0.884% | 0.448% | 49.3% | 38 | 811 |
| 53 | | 02:30 PM | 0.908% | 0.468% | 48.5% | 38 | 676 |
| 54 | | 03:00 PM | 0.904% | 0.464% | 48.7% | 38 | 676 |
| 55 | | 05:00 PM | 0.920% | 0.448% | 51.3% | 62 | 676 |
| 56 | | 08:30 PM | 0.884% | 0.440% | 50.2% | 62 | 676 |
| 57 | | 10:15 PM | 0.880% | 0.444% | 49.5% | 62 | 676 |
| 58 | | 11:15 PM | 0.880% | 0.426% | 51.6% | 50 | 676 |
| 59 | 01-Jul | 12:30 AM | 0.884% | 0.438% | 50.5% | 50 | 676 |
| 60 | | 01:30 AM | 0.896% | 0.442% | 50.7% | 50 | 676 |
| 61 | | 02:30 AM | 0.800% | 0.440% | 50.0% | 50 | 676 |
| 62 | | 03:35 AM | 0.884% | 0.436% | 50.7% | 50 | 676 |
| 63 | | 04:30 AM | 0.880% | 0.438% | 50.2% | 50 | 676 |
| 64 | | 05:25 AM | 0.868% | 0.434% | 50.0% | 50 | 676 |
| 65 | | 08:10 AM | 0.880% | 0.450% | 48.0% | 50 | 676 |
| 66 | | 08:30 AM | 0.904% | 0.444% | 50.9% | 50 | 676 |
| 67 | | 10:36 AM | 0.904% | 0.416% | 54.0% | 48 | 676 |
| 68 | | 11:40 AM | 0.900% | 0.428% | 52.4% | 48 | 676 |
| 69 | | 01:45 PM | 0.916% | 0.456% | 50.3% | 48 | 676 |
| 70 | | 03:00 PM | 0.888% | 0.436% | 50.9% | 48 | 676 |
| 71 | | 04:00 PM | 0.872% | 0.436% | 50.0% | 35 | 676 |
| 72 | | 05:00 PM | 0.872% | 0.428% | 50.9% | 35 | 676 |
| 73 | | 06:00 PM | 0.092% | 0.446% | 50.0% | 35 | 676 |
| 74 | | 08:00 PM | 0.896% | 0.440% | 50.9% | 35 | 676 |
| 75 | | 09:00 PM | 0.884% | 0.452% | 48.9% | 35 | 676 |
| 76 | | 10:15 PM | 0.904% | 0.448% | 50.4% | 35 | 676 |
| 77 | | 10:55 PM | 0.880% | 0.456% | 48.2% | 35 | 676 |
| 78 | 02-Jul | 12:05 AM | 0.884% | 0.448% | 49.3% | 35 | 691 |
| 79 | | 01:00 AM | 0.872% | 0.436% | 50.0% | 35 | 691 |
| 80 | | 02:00 AM | 0.888% | 0.442% | 50.2% | 35 | 691 |
| 81 | | 02:55 AM | 0.892% | 0.432% | 51.6% | 35 | 608 |
| 82 | | 08:18 AM | 0.884% | 0.446% | 49.5% | 35 | 478 |
| 83 | | 09:00 AM | 0.884% | 0.454% | 48.6% | 35 | 478 |
| 84 | | 10:15 AM | 0.888% | 0.440% | 50.5% | 35 | 349 |
| 85 | | 11:00 AM | 0.884% | 0.440% | 50.2% | 35 | 349 |
| 86 | | 12:00 PM | 0.872% | 0.440% | 49.5% | 35 | 349 |
| 87 | | 01:57 PM | 0.836% | 0.426% | 49.0% | 35 | 349 |
| 88 | | 03:00 PM | 0.824% | 0.418% | 49.3% | 35 | 349 |
| 89 | | 04:10 PM | 0.816% | 0.424% | 48.0% | 35 | 349 |
| 90 | | 05:00 PM | 0.840% | 0.406% | 51.7% | 35 | 349 |
| 91 | | 06:00 PM | 0.848% | 0.432% | 49.1% | 35 | 349 |
| 92 | | 06:45 PM | 0.828% | 0.40a% | 50.7% | 35 | 349 |
| 93 | | 08:50 PM | 0.826% | 0.376% | 54.6% | 35 | 349 |
| 94 | | 09:55 PM | 0.844% | 0.406% | 51.9% | 35 | 349 |

-continued

| | | | | | | | |
|---|---|---|---|---|---|---|---|
| 95 | | 11:00 PM | 0.836% | 0.414% | 50.5% | 35 | 349 |
| 96 | 03-Jul | 12:00 AM | 0.832% | 0.400% | 51.9% | 35 | 349 |
| 97 | | 01:00 AM | 0.828% | 0.408% | 50.7% | 35 | 349 |
| 98 | | 02:00 AM | 0.844% | 0.420% | 50.2% | 35 | 349 |
| 99 | | 03:00 AM | 0.856% | 0.434% | 49.3% | 35 | 386 |
| 100 | | 04:00 AM | 0.868% | 0.430% | 50.5% | 35 | 386 |
| 101 | | 04:54 AM | 0.864% | 0.428% | 50.5% | 35 | 386 |
| 102 | | 08:10 AM | 0.840% | 0.426% | 49.3% | 35 | 386 |
| 103 | | 09:00 AM | 0.828% | 0.426% | 48.6% | 35 | 386 |
| 104 | TEMP | 10:18 AM | 0.832% | 0.428% | 48.6% | 35 | 386 |
| 105 | C.A. | 11:15 AM | 0.844% | 0.424% | 49.8% | 35 | 386 |
| 106 | | 12:20 PM | 0.856% | 0.426% | 50.2% | 35 | 386 |
| 107 | 56 | 04:20 PM | 0.868% | 0.426% | 50.9% | 35 | 386 |
| 108 | 55 | 06:25 PM | 0.880% | 0.436% | 50.5% | 35 | 386 |
| 109 | 53.5 | 07:45 PM | 0.892% | 0.440% | 50.7% | 35 | 386 |
| 110 | 52.5 | 08:55 PM | 0.888% | 0.440% | 50.5% | 35 | 386 |
| 111 | 52.5 | 10:04 PM | 0.784% | 0.382% | 51.3% | 35 | 386 |
| 112 | 53.5 | 11:13 PM | 0.860% | 0.418% | 51.4% | 35 | 386 |
| 113 | 4 JUIL | 01:24 AM | 0.892% | 0.446% | 50.0% | 35 | 386 |
| 114 | 52.5 | 02:20 AM | 0.896% | 0.450% | 49.8% | 35 | 386 |
| 115 | 53 | 04:10 AM | 0.892% | 0.458% | 48.7% | 35 | 386 |
| 116 | 53 | 06:00 AM | 0.904% | 0.454% | 49.8% | 35 | 386 |
| 117 | 52.5 | 07:57 AM | 0.900% | 0.464% | 48.4% | 35 | 386 |
| 118 | 52.5 | 08:55 AM | 0.912% | 0.474% | 48.0% | 35 | 386 |
| 119 | 52.5 | 10:05 AM | 0.932% | 0.474% | 49.1% | 35 | 386 |
| 120 | 54 | 12:00 PM | 0.936% | 0.464% | 50.4% | 35 | 386 |
| 121 | — | 02:15 PM | 0.928% | 0.483% | 48.0% | 35 | 372 |
| 122 | 54 | 05:00 PM | 0.932% | 0.472% | 49.4% | 35 | 372 |
| 123 | 53.5 | 07:27 PM | 0.908% | 0.468% | 48.5% | 35 | 372 |
| 124 | 54 | 09:42 PM | 0.948% | 0.474% | 50.0% | 35 | 372 |
| 125 | 53 | 11:10 PM | 0.916% | 0.476% | 48.0% | 35 | 372 |
| 126 | 5 JUIL | 12:10 AM | 0.964% | 0.478% | 50.4% | 35 | 372 |
| 127 | 53.5 | 02:25 AM | 0.944% | 0.448% | 52.5% | 35 | 372 |
| 128 | 54 | 04:03 AM | 0.952% | 0.490% | 48.5% | 35 | 372 |
| 129 | 54 | 05:05 AM | 0.920% | 0.484% | 47.4% | 35 | 372 |
| 130 | 53.5 | 07:05 AM | 0.944% | 0.472% | 50.0% | 35 | 372 |
| 131 | 54 | 08:37 AM | 0.952% | 0.484% | 49.2% | 35 | 372 |
| 132 | 55 | 10:50 AM | 0.952% | 0.496% | 47.9% | 35 | 372 |
| 133 | 55 | 02:30 PM | 0.988% | 0.502% | 49.2% | 34 | 372 |
| 134 | 55 | 04:30 PM | 0.988% | 0.494% | 50.0% | 33 | 301 |
| 135 | 54 | 07:15 PM | 0.984% | 0.482% | 51.0% | 32 | 301 |
| 136 | 54 | 08:25 PM | 0.980% | 0.480% | 51.0% | 31 | 301 |
| 137 | 53 | 09:36 PM | 0.948% | 0.490% | 48.3% | 30 | 301 |
| 138 | 53 | 11:47 PM | 0.996% | 0.498% | 50.0% | 29 | 301 |
| 139 | 6 JUIL | 01:12 AM | 0.996% | 0.492% | 50.6% | 28 | 301 |
| 140 | 54.5 | 02:55 AM | 0.964% | 0.488% | 49.4% | 27 | 301 |
| 141 | 54 | 04:04 AM | 0.948% | 0.496% | 47.7% | 26 | 301 |
| 142 | | 05:30 AM | 0.968% | 0.492% | 49.2% | 25 | 301 |
| 143 | 55 | 07:15 AM | 0.960% | 0.480% | 49.2% | 25 | 301 |
| 144 | | 10:30 AM | 0.964% | 0.498% | 48.3% | 25 | 301 |
| 145 | | 11:30 AM | 0.932% | 0.492% | 47.2% | 25 | 301 |
| 146 | | 02:05 PM | 0.920% | 0.486% | 47.2% | 25 | 301 |
| 147 | | 04:15 PM | 0.900% | 0.468% | 48.0% | 25 | 301 |
| 148 | | 08:20 PM | 0.832% | 0.428% | 48.6% | 25 | 301 |
| 149 | | 09:20 PM | 0.916% | 0.455% | 50.4% | 25 | 301 |
| 150 | 54 | 11:04 PM | 0.936% | 0.479% | 48.8% | 25 | 301 |
| 151 | 7 JUIL | 12:30 AM | 0.952% | 0.514% | 46.0% | 25 | 301 |
| 152 | 54.5 | 01:34 AM | 0.924% | 0.511% | 44.7% | 25 | 301 |
| 153 | 54 | 03:30 AM | 0.916% | 0.506% | 44.8% | 25 | 301 |
| 154 | | 04:22 AM | 0.950% | 0.500% | 47.4% | 25 | 301 |
| 155 | 54 | 05:35 AM | 0.944% | 0.515% | 45.4% | 25 | 301 |
| 156 | | 07:00 AM | 0.932% | 0.508% | 45.5% | 25 | 301 |
| 157 | 54 | 07:49 AM | 0.936% | 0.505% | 46.0% | 25 | 301 |
| 158 | | 09:12 AM | 0.896% | 0.484% | 46.0% | 25 | 301 |
| 159 | | 10:00 AM | 0.928% | 0.474% | 48.9% | 25 | 301 |
| 160 | | 11:40 AM | 0.928% | 0.504% | 45.7% | 25 | 301 |
| 161 | | 02:00 PM | 0.892% | 0.500% | 43.9% | 25 | 301 |
| 162 | | 04:30 PM | 0.932% | 0.496% | 46.8% | 25 | 301 |
| 163 | | 06:40 PM | 0.900% | 0.492% | 45.3% | 25 | 301 |
| 164 | | 08:10 PM | 0.992% | 0.517% | 47.9% | 25 | 301 |
| 165 | 54.5 | 10:09 PM | 0.916% | 0.447% | 51.2% | 25 | 301 |
| 166 | 53 | 11:28 PM | 0.930% | 0.468% | 49.7% | 25 | 301 |
| 167 | 8 JUIL | 12:42 AM | 0.952% | 0.499% | 47.6% | 25 | 301 |
| 168 | 53 | 02:25 AM | 0.950% | 0.511% | 46.2% | 25 | 301 |
| 169 | | 04:15 AM | 0.966% | 0.515% | 46.7% | 25 | 301 |
| 170 | 50 | 08:58 PM | 0.796% | 0.344% | | 25 | 301 |
| 171 | 52.5 | 10:49 PM | 0.866% | 0.396% | 54.3% | 25 | 301 |
| 172 | 52.5 | 11:55 PM | 0.900% | 0.441% | 51.0% | 25 | 301 |
| 173 | 9 JUIL | 01:12 AM | 0.912% | 0.452% | 50.4% | 20 | 301 |
| 174 | 53.5 | 02:27 AM | 0.910% | 0.461% | 49.3% | 20 | 301 |

-continued

| | | | | | | | |
|---|---|---|---|---|---|---|---|
| 175 | 52 | 03:55 AM | 0.886% | 0.459% | 48.2% | 20 | 301 |
| 176 | 52 | 05:04 AM | 0.958% | 0.483% | 49.6% | 20 | 301 |
| 177 | | 06:25 AM | 0.942% | 0.481% | 48.9% | 20 | 301 |
| 178 | 52 | 07:28 AM | 0.944% | 0.480% | 49.2% | 25 | 301 |
| 179 | | 10:06 AM | 0.944% | 0.485% | 48.6% | 25 | 301 |
| 180 | | 11:52 AM | 0.946% | 0.496% | 47.6% | 25 | 390 |
| 181 | | 01:43 PM | 0.940% | 0.485% | 48.4% | 25 | 390 |
| 182 | | 05:50 PM | 0.950% | 0.483% | 49.1% | 25 | 390 |
| 183 | | 07:00 PM | 0.956% | 0.493% | 48.4% | 25 | 390 |
| 184 | 53.5 | 09:34 PM | 0.818% | 0.395% | 51.7% | 25 | 390 |
| 185 | 53.5 | 11:00 PM | 0.918% | 0.449% | 51.1% | 25 | 390 |
| 186 | 53 | 12:00 AM | 0.952% | 0.510% | 46.4% | 25 | 390 |
| 187 | 53 | 01:04 AM | 0.960% | 0.513% | 46.6% | 25 | 390 |
| 188 | 53.5 | 02:06 AM | 0.942% | 0.495% | 47.5% | 25 | 390 |
| 189 | 53.5 | 03:25 AM | 0.938% | 0.490% | 47.8% | 25 | 390 |
| 190 | 53.5 | 04:33 AM | 0.936% | 0.478% | 48.9% | 25 | 390 |
| 191 | 53.5 | 05:36 AM | 0.944% | 0.484% | 48.7% | 25 | 390 |
| 192 | 53 | 06:30 AM | 0.952% | 0.486% | 48.9% | 30 | 390 |
| 193 | 53 | 07:34 AM | 0.934% | 0.475% | 49.1% | 35 | 390 |
| 194 | 52.5 | 09:00 AM | 0.824% | 0.392% | 52.4% | 29 | 390 |
| 195 | 10 JUIL | 10:50 AM | 0.894% | 0.443% | 50.4% | 28 | 390 |
| 196 | | 02:54 PM | 0.856% | 0.440% | 48.6% | 28 | 390 |
| 197 | | 04:33 PM | 0.848% | 0.427% | 49.6% | 28 | 390 |
| 198 | 52.5 | 09:25 PM | 0.878% | 0.456% | 48.1% | 28 | 390 |
| 199 | 53 | 10:20 PM | 0.876% | 0.461% | 47.4% | 28 | 390 |
| 200 | 53 | 11:30 PM | 0.880% | 0.465% | 47.2% | 28 | 390 |
| 201 | 52.5 | 12:30 AM | 0.884% | 0.466% | 47.3% | 28 | 390 |
| 202 | 52 | 01:30 AM | 0.886% | 0.462% | 47.9% | 28 | 390 |
| 203 | 52.5 | 02:36 AM | 0.886% | 0.474% | 46.5% | 28 | 390 |
| 204 | 11 JUIL | 05:01 AM | 0.882% | 0.461% | 47.7% | 28 | 390 |
| 205 | 51.5 | 06:04 AM | 0.864% | 0.458% | 47.0% | 26 | 390 |
| 206 | 52.5 | 07:09 AM | 0.890% | 0.468% | 47.4% | 28 | 390 |
| 207 | 53 | 08:13 AM | 0.894% | 0.465% | 48.0% | 28 | 390 |
| 208 | | 09:45 AM | 0.916% | 0.477% | 47.9% | 28 | 390 |
| 209 | | 11:35 AM | 0.920% | 0.501% | 45.5% | 28 | 390 |
| 210 | | 02:40 PM | 0.906% | 0.477% | 47.4% | 28 | 390 |
| 211 | | 04:18 PM | 0.908% | 0.489% | 46.1% | 28 | 390 |
| 212 | 52 | 10:55 PM | 0.924% | 0.501% | 45.8% | 28 | 390 |
| 213 | 52.5 | 12:12 AM | 0.918% | 0.493% | 46.3% | 28 | 390 |
| 214 | 52.5 | 01:36 AM | 0.886% | 0.480% | 45.8% | 28 | 390 |
| 215 | 52 | 02:37 AM | 0.896% | 0.481% | 46.3% | 28 | 390 |
| 216 | 12 JUIL | 03:42 AM | 0.892% | 0.473% | 47.0% | 28 | 390 |
| 217 | 52.5 | 04:45 AM | 0.882% | 0.460% | 47.8% | 28 | 390 |
| 218 | 52 | 05:52 AM | 0.876% | 0.463% | 47.1% | 28 | 292 |
| 219 | 52.5 | 06:55 AM | 0.878% | 0.461% | 47.5% | 30 | 292 |
| 220 | | 07:55 AM | 0.892% | 0.458% | 48.7% | 30 | 292 |
| 221 | | 09:15 AM | 0.880% | 0.466% | 47.0% | 30 | 531 |
| 222 | | 10:25 AM | 0.874% | 0.461% | 47.3% | 30 | 531 |
| 223 | | 11:30 AM | 0.844% | 0.428% | 49.3% | 30 | 531 |
| 224 | | 12:25 PM | 0.854% | 0.447% | 47.7% | 30 | 531 |
| 225 | | 01:35 PM | 0.882% | 0.450% | 49.0% | 30 | 531 |
| 226 | | 02:35 PM | 0.870% | 0.460% | 47.1% | 30 | 531 |
| 227 | | 03:40 PM | 0.878% | 0.458% | 47.8% | 30 | 531 |
| 228 | | 04:20 PM | 0.866% | 0.457% | 47.2% | 30 | 531 |
| 229 | | 05:25 PM | 0.848% | 0.447% | 47.3% | 30 | 531 |
| 230 | 52.5 | 08:00 PM | 0.880% | 0.473% | 46.3% | 30 | 531 |
| 231 | 52 | 09:15 PM | 0.862% | 0.460% | 46.6% | 30 | 531 |
| 232 | 52.5 | 10:23 PM | 0.878% | 0.466% | 46.9% | 30 | 531 |
| 233 | | 11:20 PM | 0.882% | 0.468% | 46.9% | 30 | 531 |
| 234 | 52.5 | 12:20 AM | 0.876% | 0.462% | 47.3% | 30 | 531 |
| 235 | 13 JUIL | 01:25 AM | 0.874% | 0.472% | 46.0% | 30 | 531 |
| 236 | 52 | 02:33 AM | 0.894% | 0.476% | 46.8% | 30 | 531 |
| 237 | 52 | 03:34 AM | 0.888% | 0.486% | 45.3% | 30 | 531 |
| 238 | 52 | 04:36 AM | 0.882% | 0.472% | 46.5% | 30 | 531 |
| 239 | 52 | 05:34 AM | 0.880% | 0.471% | 46.5% | 30 | 531 |
| 240 | 52 | 06:35 AM | 0.878% | 0.473% | 46.1% | 30 | 337 |
| 241 | 52 | 07:35 AM | 0.894% | 0.478% | 46.5% | 30 | 337 |
| 242 | | 08:50 AM | 0.912% | 0.473% | 48.1% | 30 | 337 |
| 243 | | 10:36 AM | 0.914% | 0.469% | 48.7% | 30 | 337 |
| 244 | | 11:48 AM | 0.924% | 0.484% | 47.6% | 30 | 337 |
| 245 | | 11:58 AM | 0.928% | 0.504% | 45.7% | 30 | 337 |
| 246 | | 12:08 PM | 0.962% | 0.514% | 46.6% | 30 | 337 |
| 247 | | 12:30 PM | 0.962% | 0.510% | 47.0% | 30 | 337 |
| 248 | | 02:52 PM | 0.958% | 0.474% | 50.5% | 30 | 337 |
| 249 | | 03:04 PM | 0.946% | 0.484% | 48.8% | 30 | 337 |
| 250 | | 03:16 PM | 0.966% | 0.483% | 50.0% | 30 | 337 |
| 251 | | 03:30 PM | 0.930% | 0.488% | 47.5% | 30 | 337 |
| 252 | | 04:50 PM | 0.910% | 0.468% | 48.6% | 30 | 337 |
| 253 | 52 | 08:10 PM | 0.922% | 0.466% | 49.5% | 30 | 337 |
| 254 | 52 | 09:15 AM | 0.924% | 0.466% | 49.6% | 30 | 337 |

-continued

| | | | | | | | |
|---|---|---|---|---|---|---|---|
| 255 | 52 | 10:25 PM | 0.924% | 0.477% | 48.4% | 30 | 337 |
| 256 | 52 | 11:30 PM | 0.950% | 0.488% | 48.6% | 30 | 337 |
| 257 | 14 JUIL | 12:33 AM | 0.928% | 0.472% | 49.1% | 30 | 337 |
| 258 | 52 | 01:48 AM | 0.930% | 0.462% | 50.3% | 30 | 337 |
| 259 | 51 | 03:25 AM | 0.914% | 0.472% | 48.4% | 30 | 337 |
| 260 | 51 | 05:15 AM | 0.928% | 0.469% | 49.5% | 30 | 337 |
| 261 | 51 | 06:38 AM | 0.948% | 0.482% | 49.2% | 20 | 337 |
| 262 | 51.5 | 07:36 AM | 0.992% | 0.509% | 48.7% | 15 | 337 |
| 263 | | 09:00 AM | 0.956% | 0.535% | 44.0% | 10 | 337 |
| 264 | | 10:00 AM | 0.950% | 0.485% | 48.9% | 25 | 337 |
| 265 | | 07:38 AM | 0.904% | 0.485% | 46.3% | 30 | 337 |
| 266 | | 01:30 PM | 0.928% | 0.481% | 48.2% | 30 | 337 |
| 267 | | 03:15 PM | 0.902% | 0.465% | 48.4% | 30 | 337 |
| 268 | | | 0.882% | 0.481% | 45.5% | 30 | 337 |
| 269 | 51 | 08:00 PM | 0.886% | 0.460% | 48.1% | 30 | 337 |
| 270 | 50.5 | 09:40 PM | 0.900% | 0.474% | 47.3% | 30 | 337 |
| 271 | | 10:34 PM | 0.878% | 0.461% | 47.5% | 30 | 337 |

SAVEALL TEST RESULTS

| DATE | HOUR | IN FLOW kl/min | | CLOUDY WATER no 1 | CLOUDY WATER no 2 | CLEAR WATER no 1 | CLEAR WATER no 2 | THICK-ENED PULP | VACU-UM no.1 | VACU-UM no.2 | REMARKS |
|---|---|---|---|---|---|---|---|---|---|---|---|
| | | 16.0 | 1.041% | 0.110% | 0.114% | 0.112% | 0.139% | 3.216% | 25 | 24 | |
| 22 MAY | | 15.4 | 1.026% | 0.111% | 0.117% | 0.143% | 0.083% | 3.853% | 38 | 36 | |
| 2 JUNE | | 15.0 | 1.040% | 0.066% | 0.079% | 0.061% | 0.028% | 3.700% | | | |
| 9 JUNE | | 15.3 | 0.888% | 0.095% | 0.094% | 0.094% | 0.039% | 3.074% | 36 | 34 | |
| | | 15.4 | 0.992% | 0.098% | | 0.087% | | | | | |
| 4 JULY | 15:15 | 20.0 | 0.710% | 0.086% | 0.096% | 0.056% | 0.070% | | .33 | 35 | |
| 5 | 1:30 | 20.0 | 0.756% | 0.076% | 0.088% | 0.056% | 0.060% | | 36 | 35 | |
| | 7:30 | 20.0 | 0.710% | 0.080% | 0.084% | 0.040% | 0.072% | | 32 | 33 | |
| | 16:15 | 20.3 | 0.752% | 0.078% | 0.090% | 0.072% | 0.082% | 2.800% | 38 | 40 | |
| | 20:52 | 20.1 | 0.676% | 0.072% | 0.081% | 0.044% | 0.044% | 3.600% | 38 | 35 | |
| 6 | 0:17 | 20.1 | 1.104% | 0.090% | 0.084% | | BREAK-AGE | 3.530% | 21 | 31 | DURING BREAKAGE |
| | 3:50 | 20.1 | 0.698% | 0.090% | 0.064% | 0.060% | 0.070% | 3.620 | 30 | | |
| | 7:40 | 20.1 | 0.816% | 0.072% | 0.104% | 0.068% | 0.086% | 3.120% | | | |
| | 14:20 | 19.2 | 0.968% | 0.070% | 0.072% | 0.052% | 0.064% | 2.010% | 35 | 33 | |
| | 22:12 | 18.3 | 0.954% | 0.063% | 0.066% | 0.054% | 0.056% | 3.800% | 33 | 29 | |
| 7 | 2:07 | 0.0 | 0.864% | 0.076% | 0.076% | 0.058% | 0.072% | 3.760% | 25 | 28 | |
| | 5:55 | 19.3 | 0.844% | 0.086% | 0.080% | 0.062% | 0.050% | 3.480% | 33 | 25 | |
| 8 | 0:00 | 18.6 | 0.764% | 0.064% | 0.076% | 0.054% | 0.052% | 3.640% | 34 | 30 | |
| | 11:00 | 20.0 | 0.678% | 0.054% | 0.062% | 0.046% | 0.046% | 2.420% | | | |
| | 21:50 | 18.6 | 0.802% | 0.039% | 0.050% | 0.032% | 0.014% | 2.960% | 24 | 20 | FEW AFTER |
| 9 | 1:42 | 18.6 | 0.762% | 0.064% | 0.050% | 0.056% | 0.034% | 3.580% | 31 | 24 | |
| | 6:50 | 20.0 | 0.696% | 0.074% | 0.070% | 0.056% | 0.040% | 3.900% | 34 | 24 | |
| | 22:07 | 19.1 | 0.728% | 0.054% | 0.062% | 0.046% | 0.058% | 2.960% | 27 | 22 | |
| 10 | 2:35 | 19.4 | 0.866% | 0.068% | 0.064% | 0.046% | 0.054% | 3.140% | 35 | 24 | |
| | 7:15 | 20.0 | 0.644% | 0.062% | 0.066% | 0.044% | 0.044% | 3.620% | 37 | 24 | |
| | 22:45 | 20.0 | 0.760% | 0.074% | 0.068% | 0.062% | 0.054% | 3.740% | 39 | 23 | |
| 11 | 2:05 | 20.0 | 0.950% | 0.066% | 0.074% | 0.046% | 0.052% | 3.140% | 39 | 21 | |
| | 6:50 | 20.5 | 0.798% | 0.070% | 0.074% | 0.054% | 0.042% | 3.760% | 37 | 19 | |
| 12 | 1:20 | 20.5 | 0.680% | 0.074% | 0.070% | 0.070% | 0.062% | 2.920% | 33 | 17 | |
| | 6:15 | 20.0 | 1.038% | 0.056% | 0.056% | 0.048% | 0.052% | 3.500% | 40 | 22 | |
| | 23:10 | 20.0 | 0.810% | 0.050% | 0.048% | 0.038% | 0.038% | 3.700% | 24 | | |
| 13 | 3:05 | 20.0 | 0.632% | 0.070% | 0.076% | 0.052% | 0.056% | 3.440% | 24 | | |
| | 6:50 | 20.0 | 0.644% | 0.074% | 0.078% | 0.048% | 0.044% | 3.960% | 36 | 26 | |
| | 20:15 | 20.0 | 0.850% | 0.070% | 0.070% | 0.046% | 0.038% | 3.100% | 42 | 27 | |
| 14 | 0:10 | 20.0 | 0.760% | 0.054% | 0.060% | 0.028% | 0.028% | 3.390% | 40 | 26 | |
| | 5:40 | 20.0 | 0.998% | 0.066% | 0.074% | 0.060% | 0.074% | 3.410% | 36 | 26 | |
| | 20:25 | 20.0 | 0.768% | 0.060% | 0.074% | 0.056% | 0.068% | 3.300% | 35 | 24 | |
| 16 | 21:42 | 19.0 | 0.732% | 0.040% | 0.046% | 0.030% | 0.030% | 3.300% | 35 | 22 | |
| 17 | 2:25 | 19.0 | 0.790% | 0.050% | 0.054% | 0.028% | 0.046% | 3.627% | 29 | 25 | |
| | 6:15 | 20.0 | 0.780% | 0.060% | 0.066% | 0.048% | 0.058% | 3.800% | 34 | 32 | |

What is claimed is:

1. In a method for the production of paper, the improvement wherein one or several naphthalene sulphonate salt(s) selected from the group consisting of sodium, potassium, ammonium, calcium and aluminum salt(s) of naphthalene sulphonate, in a granulated form or as a condensed or diluted solution, and a solution of one or several polyethylene oxide having a molecular weight varying from $1\times10^6$ to $13\times10^6$ are admixed with a mixture comprising lignocellulosic fibers and fines and an aqueous medium, providing that:

said polyethylene oxide is admixed in said mixture when said mixture already contains at least a part of said naphthalene sulphonate salt(s);

the polyethylene oxide being admixed in such an amount as to represent from 10 to 700 grams per ton of dry matter of said mixture; and the naphthalene sulphonate salt(s) being admixed in such an amount as to represent from 50 to 1500 grams per ton of dry matter of said mixture.

2. A method according to claim 1, wherein said naphthalene sulphonate salt(s) comprise a condensed or diluted solution and a sufficient aqueous medium is present in said mixture so that said mixture is pumpable.

3. A method according to claim 1, wherein said naphthalene sulphonate salt(s) comprise a condensed or diluted solution and a sufficient aqueous medium is present to define an aqueous suspension.

4. A method according to claim 3, wherein said aqueous suspension is laid on a wire screen of a paper machine to form a sheet of paper.

5. A method according to claim 3, wherein said aqueous medium comprises clarified white water collected in a wire pit of a paper or pulp machine.

6. A method according to claim 3, further comprising collecting white water add recycling said white water to dilute said aqueous suspension.

7. A method according to claim 4, further comprising collecting white water comprising unretained naphthalene sulphonate salts and polyethylene oxide, and recycling said white water to prepare said mixture or as a dilution water for said aqueous suspension.

8. A method according to claim 7, wherein an equilibrium is achieved between the amount of naphthalene sulphonate salt(s) and polyethylene oxide retained on the wire screen and the amount of naphthalene sulphonate salt(s) and polyethylene oxide collected in the white water and adding to said mixture or said aqueous suspension an amount of naphthalene sulphonate salt(s) and polyethylene oxide equivalent to the amount retained in the paper.

9. A method according to claim 1, 2, 3, 4, 5, 6, 7 or 8, wherein polyethylene oxide has a molecular weight varying from $4.5\times10^6$ to $12\times10^6$.

10. A method according to claim 9, wherein there is further admixed to said mixture an enhancer consisting of a polyaluminum sulphate.

11. A method according to claim 9, wherein is further admixed to said mixture an enhancer consisting of a polyaluminum silicate sulphate.

12. A method according to claim 9, wherein there is further admixed to said mixture an enhancer consisting of a sodium aluminate.

13. A method according to claim 9, wherein there is further admixed to said aqueous mixture an enhancer consisting of polyaluminum chloride.

14. A method according to claim 9, wherein there is further admixed to said mixture an enhancer consisting of magnesium hydroxide.

15. A method according to claim 9, wherein there is further admixed to said mixture an enhancer consisting of bentonite.

16. A method according to claim 9, wherein polyethylene oxide is admixed with the mixture to represent from 30 to 100 grams per ton of dry matter of said mixture.

17. A method according to claim 16, wherein naphthalene sulphonate salt(s) is(are) admixed with the mixture to represent an amount 50 to 500 grams/ton of dry matter of said mixture.

18. A method of improving a retention of lignocellulosic fibers and fines, from a mixture comprising said lignocellulosic fibers and fines in an aqueous medium, on a wire screen and to improve a drainage of the aqueous medium, comprising adding to said mixture one or several naphthalene sulphonate salt(s) selected from the group consisting of sodium, potassium ammonium, calcium and aluminum salt(s), said salt(s) being in a granulated form or as a condensed or diluted solution, and a solution of one or several polyethylene oxide having a molecular weight varying from $1\times10^6$ to $13\times10^6$; the polyethylene oxide being admixed in such an amount as to represent from 10 to 700 grams per ton of dry matter of said mixture and the naphthalene sulphonate salt(s) being admixed in such an amount as to represent from 50 to 1500 grams per ton of dry matter of said mixture.

19. A method according to claim 18, wherein said naphthalene sulphonate salt(s) comprise a condensed or diluted solution, and a sufficient aqueous medium is present in said mixture so that said mixture is pumpable.

20. A method according to claim 18, wherein said naphthalene sulphonate salt(s) comprise a condensed or diluted solution, and a sufficient aqueous medium is present to define an aqueous suspension.

21. A method according to claim 20, wherein said aqueous suspension is laid on a wire screen of a paper machine to form a sheet of paper.

22. A method according to claim 20, wherein said aqueous medium comprises clarified white water collected in a wire pit of a paper or pulp machine.

23. A method according to claim 20, further comprising collecting white water and recycling said white water to dilute said aqueous suspension.

24. A method according to claim 20, further comprising collecting white water comprising unretained naphthalene sulphonate salts and polyethylene oxide, and recycling said white water to prepare said mixture or as a dilution water for said aqueous suspension.

25. A method according to claim 24, wherein an equilibrium is achieved between the amount of naphthalene sulphonate salt(s) and polyethylene oxide retained on the wire screen and the amount of naphthalene sulphonate salt(s) and polyethylene oxide collected in the white water and adding to said mixture or said aqueous suspension, an amount of naphthalene sulphonate salt(s) and polyethylene oxide equivalent to the amount retained in the paper.

26. A method according to claim 18, 19, 20, 21, 22, 23, 24 or 25 wherein polyethylene oxide has a molecular weight varying from $4.5\times10^6$ to $12\times10^6$ .

27. A method according to claim 26, wherein there is further admixed to said mixture an enhancer consisting of a polyaluminum sulphate.

28. A method according to claim 26, wherein there is further admixed to said mixture an enhancer consisting of a polyaluminum silicate sulphate.

29. A method according to claim 26, wherein there is further admixed to said mixture an enhancer consisting of a sodium aluminate.

30. A method according to claim 26, wherein there is further admixed to said mixture an enhancer consisting of polyaluminum chloride.

31. A method according to claim 26, wherein there is further admixed to said mixture an enhancer consisting of magnesium hydroxide.

32. A method according to claim 26, wherein there is further admixed to said mixture an enhancer consisting of bentonite.

33. A method according to claim 26, wherein polyethylene oxide is admixed with the mixture to represent from 30 to 100 grams per ton of dry matter of said mixture.

34. A method according to claim 33, wherein naphthalene sulphonate salt(s) is(are) admixed with the mixture to represent an amount 100 to 500 grams/ton of dry matter of said mixture.

* * * * *